US009362071B2

(12) United States Patent
Boucher et al.

(10) Patent No.: US 9,362,071 B2
(45) Date of Patent: Jun. 7, 2016

(54) GAS DENSITY MONITORING SYSTEM

(75) Inventors: Randall Boucher, Saco, ME (US); Vitaliy Demin, Saco, ME (US); James A. Webber, Saco, ME (US); John Eastman, Scarborough, ME (US); Christopher D. Farrar, Lyman, ME (US)

(73) Assignee: Franklin Fueling Systems, Inc., Madison, WI (US)

( * ) Notice: Subject to any disclaimer, the term of this patent is extended or adjusted under 35 U.S.C. 154(b) by 953 days.

(21) Appl. No.: 13/411,011

(22) Filed: Mar. 2, 2012

(65) Prior Publication Data

US 2012/0306656 A1 Dec. 6, 2012

Related U.S. Application Data

(60) Provisional application No. 61/448,585, filed on Mar. 2, 2011.

(51) Int. Cl.

| | |
|---|---|
| ***G08B 21/00*** | (2006.01) |
| ***H01H 33/56*** | (2006.01) |
| ***H01H 33/26*** | (2006.01) |

(52) U.S. Cl.

CPC ..... *H01H 33/563* (2013.01); *H01H 33/26* (2013.01)

(58) Field of Classification Search

None

See application file for complete search history.

(56) References Cited

U.S. PATENT DOCUMENTS

| | | | | |
|---|---|---|---|---|
| 3,831,430 | A | | 8/1974 | Azinger, Jr. |
| 3,887,915 | A | | 6/1975 | Olsen et al. |
| 4,057,699 | A | | 11/1977 | Reis |
| 4,829,149 | A | | 5/1989 | Jeanjean et al. |
| 4,977,513 | A | | 12/1990 | LaPalme |
| 5,128,269 | A | | 7/1992 | Oitate et al. |
| 5,388,451 | A | | 2/1995 | Stendin et al. |
| 5,421,190 | A | | 6/1995 | Brandle et al. |
| 5,502,435 | A | | 3/1996 | Ralston |
| 5,629,869 | A | | 5/1997 | Johnson et al. |
| 5,636,134 | A | * | 6/1997 | Johnson et al. ..... 702/34 |
| 5,638,296 | A | | 6/1997 | Johnson et al. |
| 5,693,873 | A | | 12/1997 | Thuries et al. |
| 5,801,461 | A | | 9/1998 | Anger et al. |
| 6,023,404 | A | | 2/2000 | Marmonier |
| 6,125,692 | A | | 10/2000 | Marmonier |
| 6,205,846 | B1 | | 3/2001 | Dupraz et al. |
| 6,231,227 | B1 | | 5/2001 | Anderson |
| 6,236,548 | B1 | | 5/2001 | Marmonier |
| 6,263,914 | B1 | | 7/2001 | Meyer et al. |
| 6,324,891 | B1 | | 12/2001 | Gibeault et al. |
| 6,337,570 | B1 | | 1/2002 | Audren et al. |
| 6,361,205 | B2 | | 3/2002 | Anderson |
| 6,466,023 | B2 | | 10/2002 | Dougherty et al. |
| 6,522,247 | B2 | | 2/2003 | Maruyama et al. |
| 6,651,483 | B1 | | 11/2003 | Meyer et al. |
| 6,845,301 | B2 | | 1/2005 | Hamamatsu et al. |

(Continued)

OTHER PUBLICATIONS

WIKA, SF6 Gas Excellence, Aug. 2011.

(Continued)

*Primary Examiner* — Curtis King

(74) *Attorney, Agent, or Firm* — Faegre Baker Daniels LLP

(57) ABSTRACT

A circuit breaker monitoring system may monitor both at least one gas characteristic of a gas surrounding the circuit breaker and at least one fault arc energy characteristic. The monitored characteristics may be used to forecast maintenance events. The monitored characteristics may be used to control the operation of the circuit breaker.

40 Claims, 23 Drawing Sheets

(56) References Cited

U.S. PATENT DOCUMENTS

| | | | | |
|---|---|---|---|---|
| 6,921,428 | B2 | 7/2005 | Yamamoto et al. | |
| 7,145,322 | B2 | 12/2006 | Solveson et al. | |
| 7,184,895 | B2 | 2/2007 | Chetay et al. | |
| 7,253,602 | B2 | 8/2007 | Shvach et al. | |
| 7,257,496 | B2 * | 8/2007 | Rhodes et al. | 702/51 |
| 7,388,384 | B2 | 6/2008 | Kato et al. | |
| 7,417,554 | B2 | 8/2008 | Benke et al. | |
| 7,612,988 | B2 | 11/2009 | Ulinskas | |
| 7,675,738 | B2 | 3/2010 | Fukunaga et al. | |
| 7,684,881 | B2 | 3/2010 | Lloyd | |
| 7,755,362 | B2 | 7/2010 | Stelter | |
| 7,791,846 | B2 | 9/2010 | Roscoe et al. | |
| 7,816,924 | B2 | 10/2010 | Kanazawa et al. | |
| 7,937,985 | B2 | 5/2011 | Chambon | |
| 2005/0168891 | A1 | 8/2005 | Nilman-Johnsson et al. | |
| 2007/0241079 | A1 * | 10/2007 | Johnson et al. | 218/66 |
| 2008/0192389 | A1 * | 8/2008 | Muench et al. | 361/5 |
| 2008/0314873 | A1 | 12/2008 | Dahlquist et al. | |
| 2009/0015991 | A1 | 1/2009 | Hyrenbach et al. | |
| 2010/0019573 | A1 | 1/2010 | Biester et al. | |
| 2010/0072174 | A1 | 3/2010 | Asokan et al. | |
| 2010/0102036 | A1 | 4/2010 | Maruyama et al. | |
| 2010/0141050 | A1 * | 6/2010 | Saito et al. | 307/141 |
| 2010/0326958 | A1 | 12/2010 | Gregoire et al. | |
| 2010/0326959 | A1 | 12/2010 | Kanazawa et al. | |
| 2011/0073568 | A1 | 3/2011 | Gibson et al. | |
| 2011/0127237 | A1 | 6/2011 | Uchii et al. | |
| 2012/0118043 | A1 * | 5/2012 | Heckler et al. | 73/30.02 |

OTHER PUBLICATIONS

Zarko Djekic, "Online Circuit Breaker Monitoring System", Thesis, Texas A & M University, Dec. 2007.

J.P. Dupraz et al., "Remote Supervision for Intelligent Circuit Breakers and Gas Insulated Substations", Jul. 2008, IEEE.

InuoSys, "On-Line Circuit Breaker Condition Monitor BMS 1000", at least as early as Jul. 29, 2011.

Mladen Kezunovic et al., Power Systems Engineering Research Center, "Automated Circuit Breaker Monitoring", Nov. 2007.

Anton Pöltl et al., "Field Experiences with HV Circuit Breaker Condition Monitoring", ABB, Jun. 2011.

C. Sweetser et al., "Strategies for Selecting Monitoring of Circuit Breakers", IEEE Transactions on Power Delivery, vol. 17, No. 3, Jul. 2002.

INCON, "Circuit Breaker Wear and Condition Monitor", at least as early as Feb. 2012.

ABB, "Circuit Breaker Sentinel (CBS) for SF6 Power Circuit Breakers", Nov. 2011.

Siemens, "Substation Monitoring System SF6 Gas Density Monitoring", at least as early as Feb. 2012.

Granzow, Inc., "Model 8774 Trafag SF6 Gas Density Controls", 2013.

WIKA, "Gas Management for the Smart Grid", IEEE, Chicago, Apr. 2008.

Siemens, "SPS2 Circuit Breaker", 2006.

WIKA, "SF6 Emission Monitoring: State-of-the-Art SF6 Tracking", EPA Workshop 2009.

International Search Report and Written Opinion dated Jul. 10, 2012 in PCT International Application No. PCT/US2012/027501.

* cited by examiner

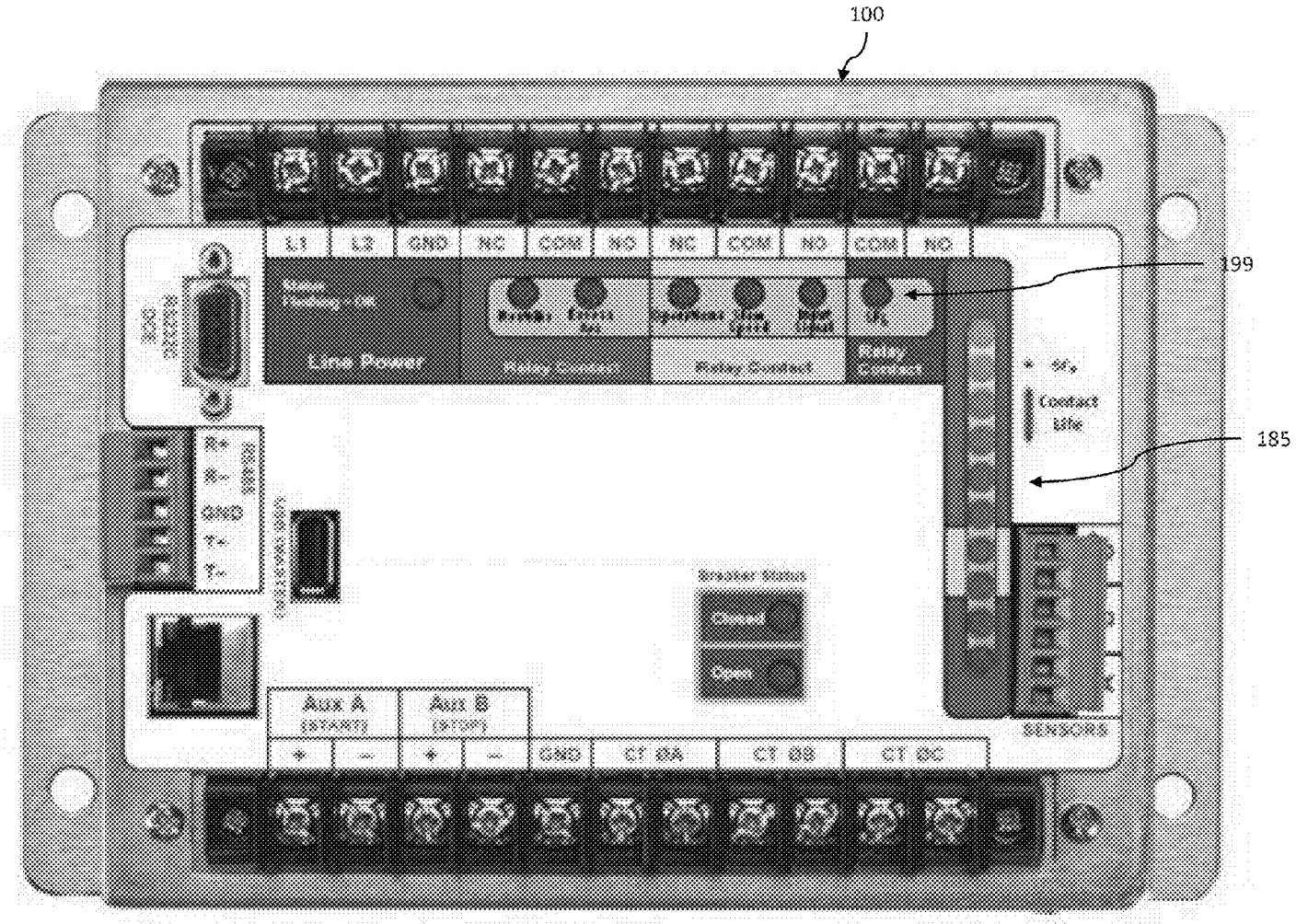
100
199
185
NO
COM
NO
COM
NC
NO
COM
NC
GND
L2
L1
Contact Life
Contact Life
Contact Life

738

752

| GAS DENSITY (D) | FAULT ARC ENERGY ($I^2T$) |
|---|---|
| $\{D_1\}$ | $\{I^2T_1\}$ |
| $\{D_2\}$ | $\{I^2T_2\}$ |
| $\{D_3\}$ | $\{I^2T_3\}$ |
| $\{D_4\}$ | $\{I^2T_4\}$ |
| $\{D_5\}$ | $\{I^2T_5\}$ |
| $\{D_6\}$ | $\{I^2T_6\}$ |
| $\{D_7\}$ | $\{I^2T_7\}$ |
| $\{D_8\}$ | $\{I^2T_8\}$ |

○
○
○

GAS DENSITY MONITORING SYSTEM

RELATED APPLICATIONS

This application claims the benefit of U.S. Provisional Application Ser. No. 61/448,585, filed Mar. 2, 2011, titled GAS DENSITY MONITORING SYSTEM, the entire disclosure of which is expressly incorporated by reference herein.

FIELD

The present invention relates generally to systems and methods related to monitoring circuit breakers and in particular to monitoring gas levels associated with the circuit breakers.

BACKGROUND

High voltage circuit breakers have an open state wherein electricity is not transmitted through the circuit breaker and a closed state wherein electricity is transmitted through the circuit breaker. To transition between these states electrical conductors are either brought into contact with each other or separated relative to each other. As the circuit breaker transitions between these states one or more undesired arcs of electrical energy may be transmitted between the electrical conductors.

It is known to house the electrical conductors within a housing that is filled with an arc quenching fluid. An exemplary arch quenching fluid is a gas containing SF6. The SF6 gas acts to reduce the occurrence or intensity of undesired arc events.

The occurrence of undesired arc events may contribute to the degradation of the circuit breaker components. Over time the circuit breaker components need to be replaced or the arc quenching gas needs to be refilled.

SUMMARY

The present invention relates generally to systems and methods related to monitoring circuit breakers and in particular to monitoring gas levels associated with the circuit breakers.

In an exemplary embodiment of the present disclosure, a method of monitoring a circuit breaker provided in a gas filled enclosure is provided. The method comprising determining at least one gas characteristic of the gas in the enclosure; determining at least one fault arc energy characteristic of the circuit breaker; and forecasting with an electronic controller a maintenance event for the circuit breaker based on both the determined at least one gas characteristic and the determined at least one fault arc energy characteristic. In an example thereof, the at least one gas characteristic includes a gas density. In a variation thereof, the at least one fault energy characteristic includes an INT duty wherein I is a current passing through the circuit breaker, T is a time period, and N is in the range of about 1 to about 2. In another example thereof, the method further comprises the step of providing an indication of the forecasted maintenance event to a remote computing device. In still another example thereof, the step of forecasting the maintenance event includes determining an expected value of the at least one fault arc energy characteristic at a corresponding expected value of the at least one gas characteristic, the corresponding expected value of the at least one gas characteristic being less than the determined at least one gas characteristic. In yet still another example thereof, the step of forecasting the maintenance event includes the steps of determining an expected value of the at least one fault arc characteristic at a future time value, the expected value of the at least one fault arc characteristic being determined based on an expected value of the at least one gas characteristic at the future time value; determining if the expected value of the at least one fault arc characteristic causes a limit value for the at least one fault arc characteristic to be reached; and if the limit value is caused to be reached based on the expected value of the at least one fault arc characteristic then forecasting the maintenance event to occur at the future time value. In yet still another example thereof, the step of forecasting the maintenance event includes the steps of selecting a future time (Ti) to evaluate for a potential maintenance event; determining an expected fault arc energy ( ) at the future time (Ti) based on an expected value of the at least one gas characteristic, wherein N is a number of future arc events and (I2T)j is an expected fault arc energy for the jth arc event; determining a cumulative fault arc energy based on a historical fault arc energy and the expected fault arc energy; and comparing the cumulative fault arc energy with a limit to determine if the future time (Ti) corresponds to a maintenance event. In a further example thereof, the step of forecasting the maintenance event includes the steps of determining a future time whereat the at least one fault arc characteristic of a first arc event corresponds to a maintenance event. In a variation thereof, the at least one gas characteristic at the future time being determined based on a trend of the at least one gas characteristic and the at least one fault arc characteristic of the first arc event is based on the at least one gas characteristic at the future time. In still a further example thereof, the step of forecasting the maintenance event includes the steps of determining a future time whereat the at least one fault arc characteristic of a plurality of arc events correspond to a maintenance event. In a variation thereof, the at least one gas characteristic at the future time being determined based on a trend of the at least one gas characteristic and the at least one fault arc characteristic of the plurality of arc events is based on the at least one gas characteristic at the future time. In a further variation thereof, the plurality of arc events are clustered at the future time. In another variation thereof, the plurality of arc events are spaced apart between a current time and the future time. In yet still another example, the step of forecasting the maintenance event includes the steps of determining a number of future arc events within a time period prior to a maintenance event. In a variation thereof, the number of future arc events being based on a decreasing trend of the at least one gas characteristic. In another variation thereof, the number of future arc events being based on the at least one gas characteristic being set to a first value.

In another exemplary embodiment of the present disclosure, a monitoring system for a circuit breaker being monitored by at least one current sensor operatively coupled to the circuit breaker and being provided in an interior of a gas filled enclosure being monitored by at least one gas sensor in fluid communication with the interior of the gas filled enclosure is provided. The system comprising a monitoring unit operatively coupled to the at least one current sensor and the at least one gas sensor. The monitoring unit including an electronic controller configured to forecast a maintenance event for the circuit breaker based on both the determined at least one gas characteristic and the determined at least one fault arc energy characteristic. In an example thereof, the system further comprises a visual indicator which provides a visual indication of a plurality of conditions associated with the circuit breaker. In a variation thereof, the visual indicator toggles between an indication of the remaining contact life of the circuit breaker and an indication of the gas density surrounding the circuit breaker.

In yet another exemplary embodiment of the present disclosure, a monitoring system for a circuit breaker being monitored by at least one current sensor operatively coupled to the circuit breaker and being provided in an interior of a gas filled enclosure being monitored by at least one gas sensor in fluid communication with the interior of the gas filled enclosure is provided. The system comprising a monitoring unit operatively coupled to the at least one current sensor and the at least one gas sensor, the monitoring unit including an electronic controller configured to forecast a maintenance event for the circuit breaker; and a visual indicator which provides a visual indication of a plurality of conditions associated with the circuit breaker. The visual indicator toggles between an indication of the remaining contact life of the circuit breaker and an indication of the gas density surrounding the circuit breaker.

In still yet another exemplary embodiment of the present disclosure, a method of controlling a circuit breaker provided in a gas filled enclosure is provided. The method comprising determining at least one gas characteristic of the gas in the enclosure; determining at least one fault arc energy characteristic of the circuit breaker; and preventing an operation of the circuit breaker if a subsequent arc event corresponds to a potential failure of the circuit breaker, the subsequent arc event being determined based on both the determined at least one gas characteristic and the determined at least one fault arc energy characteristic. In an example thereof, the at least one gas characteristic includes a gas density. In a variation thereof, the at least one fault energy characteristic includes an INT duty wherein I is a current passing through the circuit breaker, T is a time period, and N is in the range of about 1 to about 2.

In still another exemplary embodiment of the present disclosure, a monitoring system for a circuit breaker being monitored by at least one current sensor operatively coupled to the circuit breaker and being provided in an interior of a gas filled enclosure being monitored by at least one gas sensor in fluid communication with the interior of the gas filled enclosure is provided. The system comprising a monitoring unit operatively coupled to the at least one current sensor and the at least one gas sensor, the monitoring unit including an electronic controller configured to prevent an operation of the circuit breaker if a subsequent arc event corresponds to a potential failure of the circuit breaker, the subsequent arc event being determined based on both the determined at least one gas characteristic and the determined at least one fault arc energy characteristic.

In still a further exemplary embodiment of the present disclosure, a method of monitoring a circuit breaker provided in a gas filled enclosure is provided. The method comprising determining an initial mass of a gas of the gas filled enclosure; receiving an initial density of the gas of the gas filled enclosure from a density sensor; receiving a first density of the gas of the gas filled enclosure from the density sensor, the first density corresponding to a first instance in time; and determining with an electronic controller a gas loss mass of the gas of the gas filled enclosure at the first time based on the initial mass of the gas, the initial density of the gas, and the first density of the gas. In an example thereof, the method further comprises the step of determining if the density of the gas at the first time is less than the initial density of the gas by a threshold amount.

In yet another exemplary embodiment of the present disclosure, a monitoring system for a circuit breaker being monitored by at least one current sensor operatively coupled to the circuit breaker and being provided in an interior of a gas filled enclosure being monitored by at least one gas sensor in fluid communication with the interior of the gas filled enclosure is provided. The system comprising a monitoring unit operatively coupled to the at least one current sensor and the at least one gas sensor. The monitoring unit including an electronic controller configured to at least one of forecast a maintenance event for the circuit breaker and prevent an operation of the circuit breaker if a subsequent arc event corresponds to a potential failure of the circuit breaker; and a port to receive a portable memory device, the portable memory device including at least one script to at least one of upload information to a memory associated with the electronic controller and download information from the memory associated with the electronic controller. In one example thereof, the portable memory device includes at least one script to be executed when the portable memory device is coupled to the port. In a variation thereof, a first script is an Alarm Reset script configured to cause the electronic controller of the monitoring unit to reset at least one active alarms. In another example, the portable memory device includes a script selection input 170 which is actuatable from an exterior of the portable memory device. The script selection input having a plurality of settings each corresponding to a unique script. In a further example, the electronic controller forecasts the maintenance event based on both the determined at least one gas characteristic and the determined at least one fault arc energy characteristic. In still a further example, the subsequent arc event is determined based on both the determined at least one gas characteristic and the determined at least one fault arc energy characteristic.

In a further exemplary embodiment of the present disclosure, a monitoring system for a circuit breaker being monitored by at least one sensor is provided. The system comprising a monitoring unit operatively coupled to the at least one sensor. The monitoring unit including an electronic controller based on input from the at least one sensor being configured to at least one of forecast a maintenance event for the circuit breaker and prevent an operation of the circuit breaker if a subsequent arc event corresponds to a potential failure of the circuit breaker; and at least one sensor connection adapted to couple to the at least one sensor, wherein when the at least one sensor is coupled to the at least one sensor connection the electronic controller configures the at least one sensor has one of an analog sensor and a digital sensor and verifies the presence of the at least one sensor. In an example thereof, if the at least one sensor is not providing a signal the electronic controller initiates an alarm. In another example thereof, the electronic controller records a plurality of readings from the at least one sensor and if a present readings differs from at least one prior reading by more than a threshold amount the electronic controller initiates an alarm.

In still a further exemplary embodiment of the present disclosure, a monitoring system for a circuit breaker provided in an interior of a gas filled enclosure being monitored by at least one gas sensor in fluid communication with the interior of the gas filled enclosure is provided. The system comprising a monitoring unit operatively coupled to the at least one sensor. The monitoring unit including an electronic controller based on input from the at least one gas sensor being configured to at least one of forecast a maintenance event for the circuit breaker and prevent an operation of the circuit breaker if a subsequent arc event corresponds to a potential failure of the circuit breaker. The electronic controller records measurement readings received from the at least one gas sensor over a first calculation period, determines a trend line for the measurement readings, a confidence level for the trend line, and based on a characteristic of the trend line and the confidence level determines if an alarm condition is present.

In yet still a further exemplary embodiment of the present disclosure, a monitoring system for a circuit breaker provided in an interior of a gas filled enclosure being monitored by at least one gas sensor in fluid communication with the interior of the gas filled enclosure is provided. The system comprising a monitoring unit operatively coupled to the at least one sensor. The monitoring unit including an electronic controller based on input from the at least one gas sensor being configured to at least one of forecast a maintenance event for the circuit breaker and prevent an operation of the circuit breaker if a subsequent arc event corresponds to a potential failure of the circuit breaker. The electronic controller records measurement readings received from the at least one gas sensor over a first calculation period and over a second calculation period, the second calculation period including the first calculation period; determines a first trend line for the measurement readings of the first calculation period; determines a second trend line for the measurement readings of the second calculation period; selecting one of the first trend line and the second trend line; and forecasting the maintenance event based on a characteristic of the selected trend line.

In another exemplary embodiment of the present disclosure, a monitoring system for a circuit breaker provided in an interior of a gas filled enclosure being monitored by at least one gas sensor in fluid communication with the interior of the gas filled enclosure is provided. The system comprising a monitoring unit operatively coupled to the at least one sensor. The monitoring unit including an electronic controller based on input from the at least one gas sensor being configured to at least one of forecast a maintenance event for the circuit breaker and prevent an operation of the circuit breaker if a subsequent arc event corresponds to a potential failure of the circuit breaker, wherein the electronic controller determines a fill event wherein additional gas is provided to the interior of the enclosure based on measurement readings from the at least one gas sensor. In an example thereof, the electronic controller records measurement readings received from the at least one gas sensor over a first calculation period and over a second calculation period, the second calculation period including a more current measurement reading than the first calculation period; determines a first mean density value for the first calculation period; and determines a second mean density value for the second calculation period, wherein the fill event is determined based on the second mean density value exceeding the first mean density value.

In yet another exemplary embodiment of the present disclosure, a monitoring system for a circuit breaker provided in an interior of a gas filled enclosure being monitored by at least one gas sensor in fluid communication with the interior of the gas filled enclosure is provided. The system comprising a monitoring unit operatively coupled to the at least one sensor. The monitoring unit including an electronic controller based on input from the at least one gas sensor being configured to at least one of forecast a maintenance event for the circuit breaker and prevent an operation of the circuit breaker if a subsequent arc event corresponds to a potential failure of the circuit breaker; a fill valve being in fluid communication with the interior of the gas filled enclosure; and a volumetric flowmeter operatively coupled to the electronic controller and located to monitor an amount of gas being passed through the fill valve to the interior of the gas filled enclosure. In an example thereof, the volumetric flowmeter is supported by a pressurized gas supply coupled to the fill valve. In another example, the volumetric flowmeter is supported by the enclosure.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

FIG. 16 is a front view of an exemplary embodiment of the monitoring unit of FIGS. 1A and 1B;

Figure 1A:
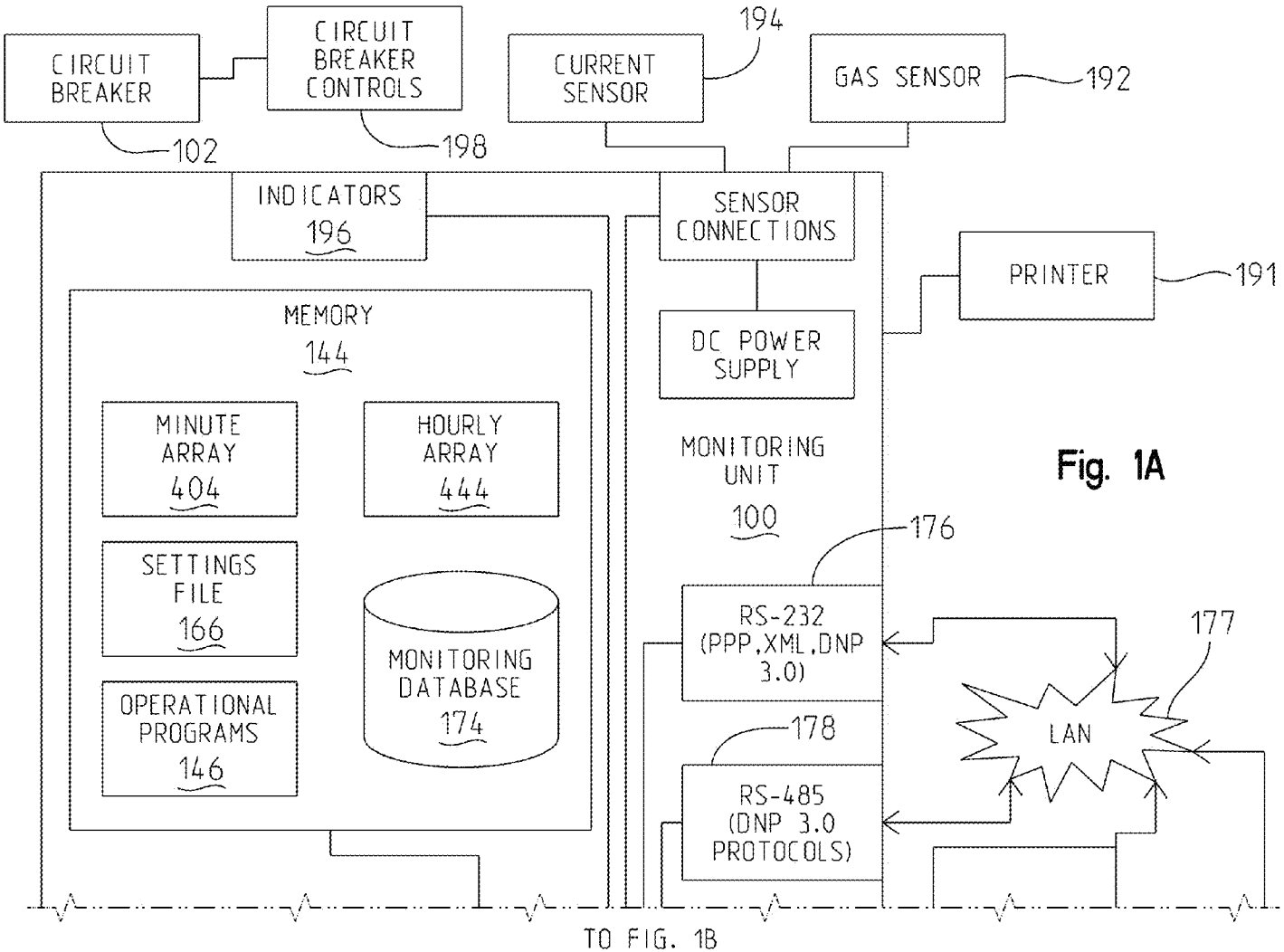
FIGS. 1A and 1B is a representative view of an exemplary monitoring system.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Figure 1B:
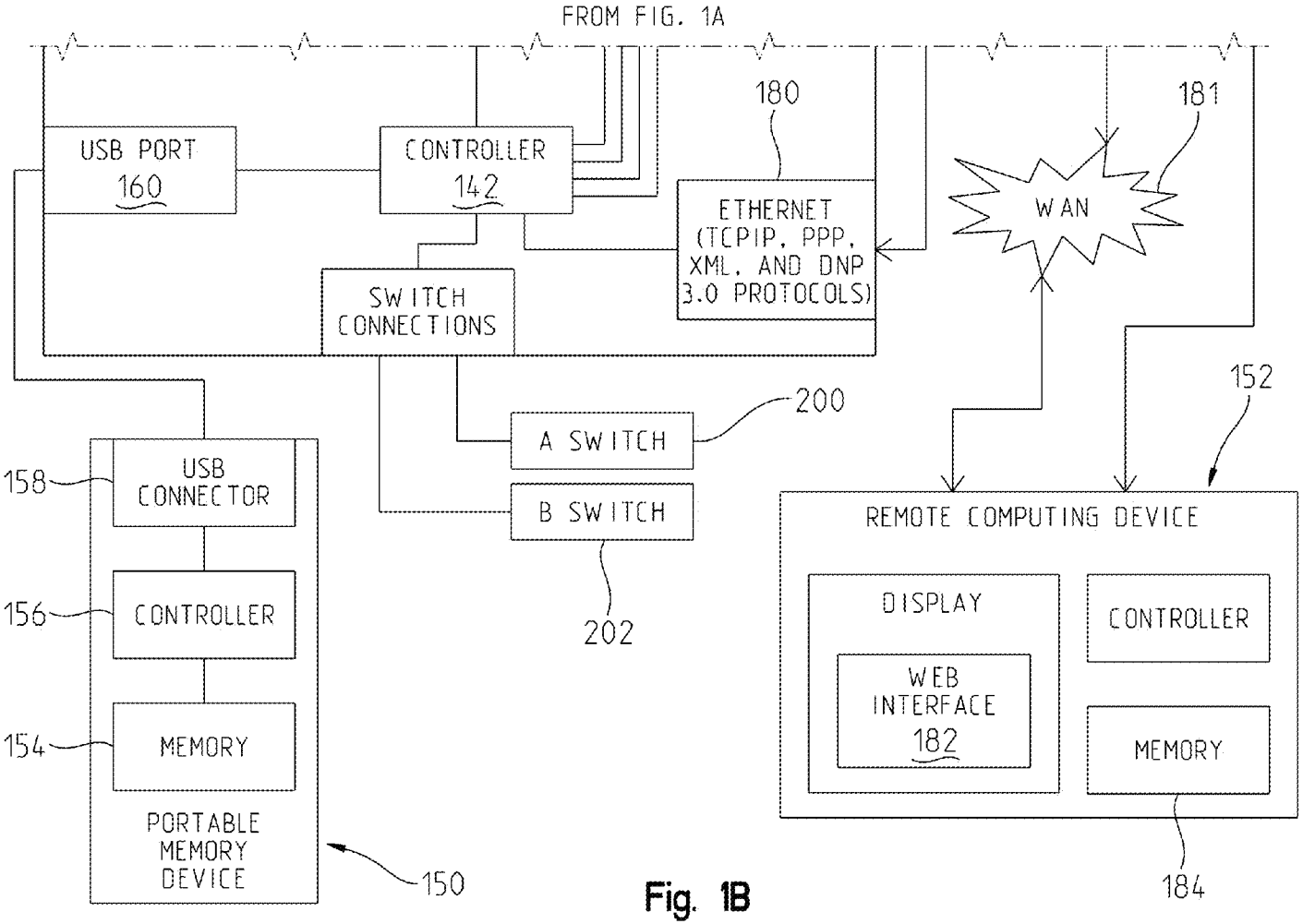
Figure 3A:
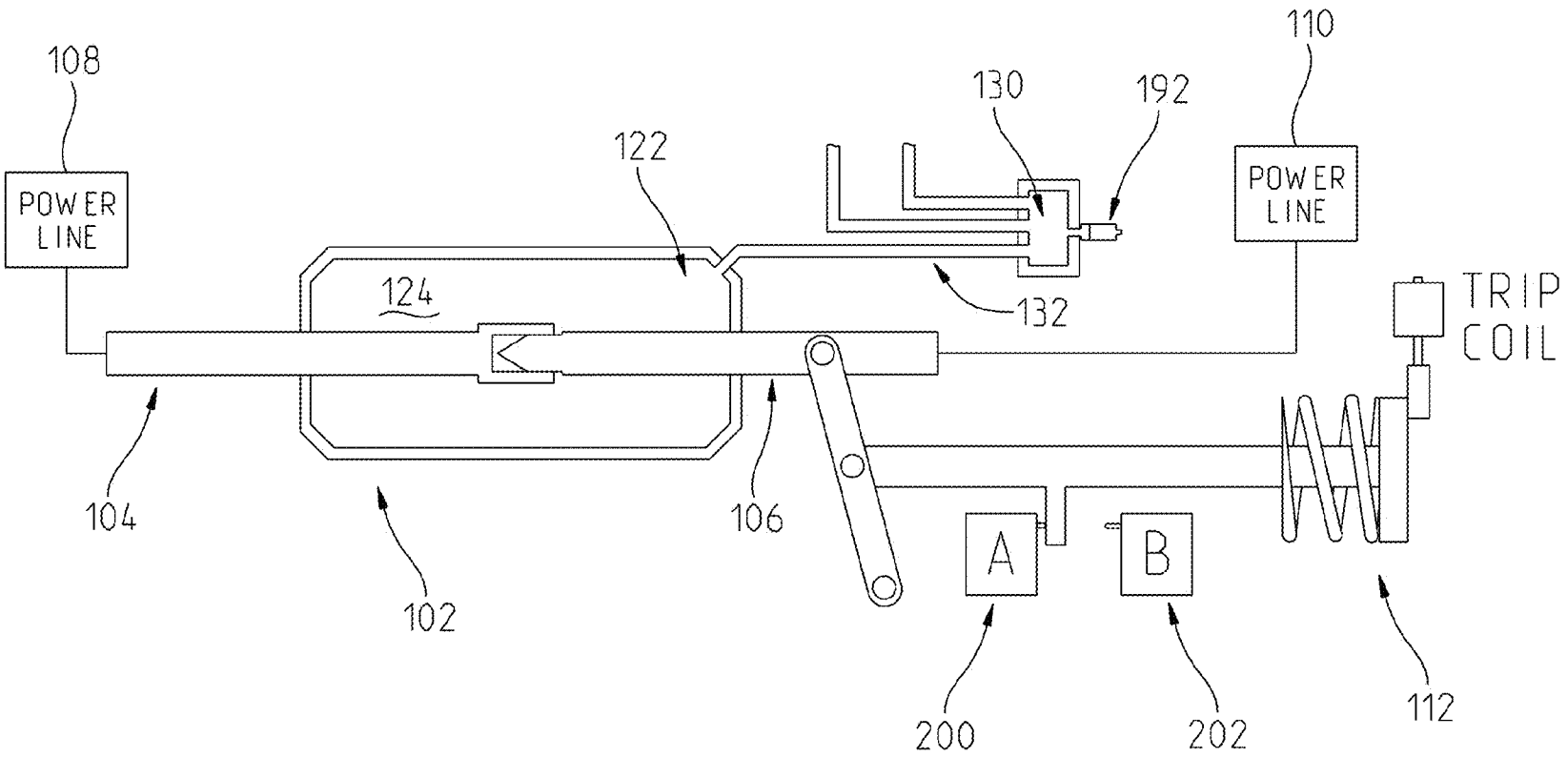
FIG. 3A is a representative view of an exemplary circuit breaker having an enclosure containing a gas, the circuit breaker being in a closed state.

Referring to FIGS. 1A and 1B, an exemplary monitoring system 100 is shown. Monitoring system 100 is configured to monitor one or more aspects of a circuit breaker 102 (see FIG. 3A) used in high power systems. Exemplary high power systems include utility sub-stations. Referring to FIG. 3A, circuit breaker 102 includes a first conductive element 104 and a second conductive element 106 which is movable relative to first conductive element 104. When first conductive element 104 is in physical contact with second conductive element 106, electricity is able to flow between a first power line 108 and a second power line 110. By contrast, when first conductive element 104 is separated from second conductive element 106, electricity generally is unable to flow between the first power line 108 and the second power line 110.

Figure 3B:
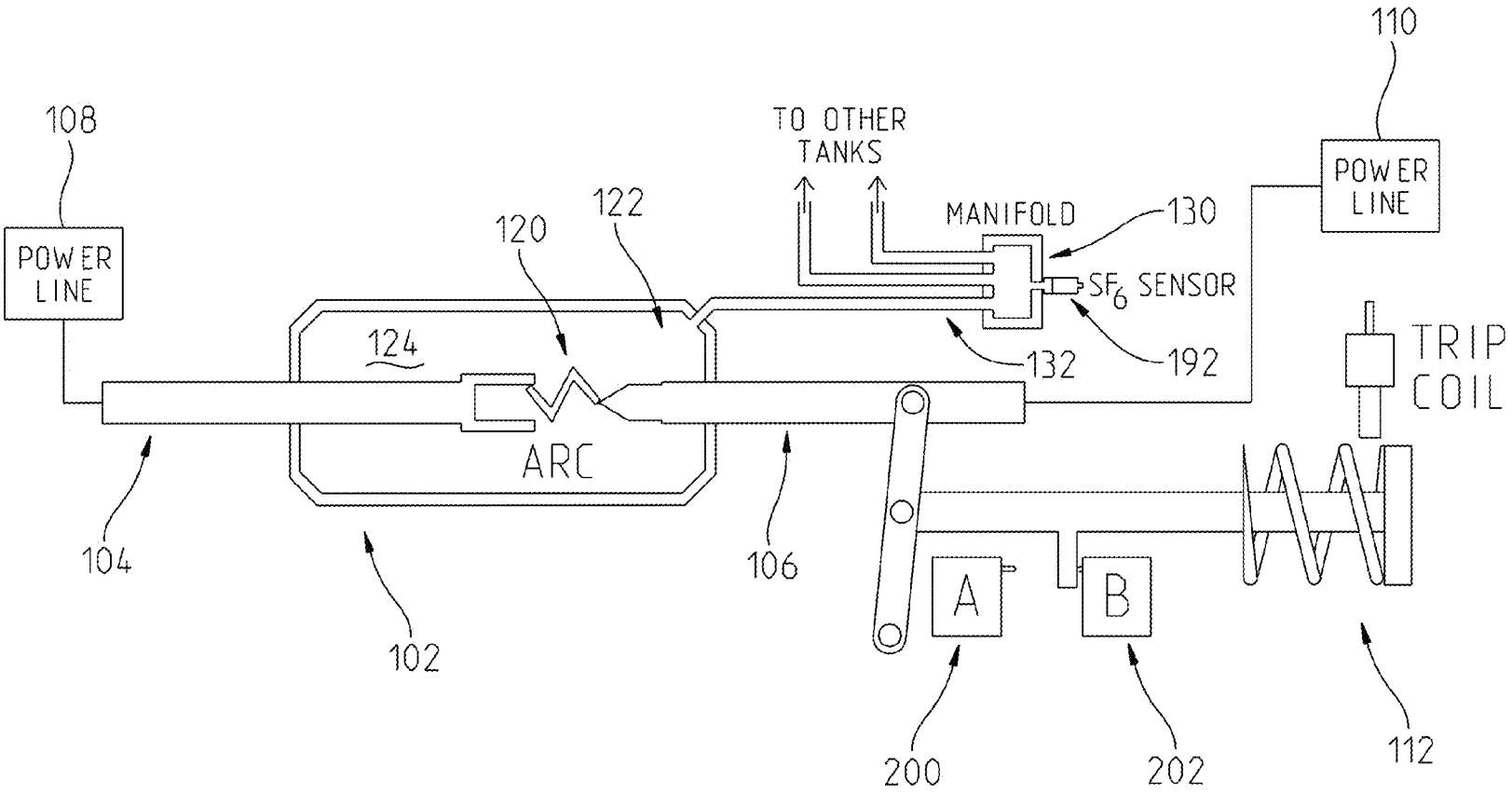
FIG. 3B is a representative view of the circuit breaker of FIG. 3A being in an open state.

As shown in FIG. 3A, second conductive element 106 is in physical contact with first conductive element 104, hence circuit breaker 102 is in a closed state. As shown in FIG. 3B, second conductive element 106 is separated from first conductive element 104, hence circuit breaker 102 is in an open state. Second conductive element 106 is movable relative to first conductive element 104 through a plunger system 112.

Circuit breaker controls 198 activates a trip coil 196 which permits circuit breaker 102 to transition to the open state of FIG. 3B. A closing spring system (not shown) is controlled by circuit breaker controls 198 to transition circuit breaker 102 back to the closed state of FIG. 3A. In the illustrated embodiment, the operation of circuit breaker 102 is independent of monitoring system 100 which monitors circuit breaker 102.

As circuit breaker 102 transitions from the closed state of FIG. 3A to the open state of FIG. 3B, an arc 120 between first conductive element 104 and second conductive element 106 is sometimes generated. In order to minimize the occurrence, the intensity, and/or duration of arc 120, the connection between first conductive element 104 and second conductive element 106 is surrounded by an enclosure 122 filled with a gas 124. An exemplary gas is Sulphur-Hexa-Fluoride ("SF6") or a mixture including SF6. Other exemplary gases may be used. The presence of the gas 124 as a dielectric reduces the amount of damage experienced by circuit breaker 102 due to arc 120 because gas 124 acts to extinguish the arc 120. An exemplary circuit breaker 102 and enclosure 122 are the Siemens SPS2 circuit breaker (15 kV-245 kV) available from Siemens Power Transmission and Distribution located at 444 Hwy. 49 S in Richland, Miss. 39218 USA.

Enclosure 122 provides a generally sealed volume around the connection between first conductive element 104 and second conductive element 106. The gas 124 in enclosure 122 does over time leak from the interior of enclosure 122 to the exterior of enclosure 122. As shown in FIG. 3B, a manifold 130 is in fluid communication with the interior of enclosure 122 and the interior of other enclosures. Manifold 130 supports a gas sensor 192 and exposes the gas sensor 192 to the gas 124 in manifold 130 which is generally at the same pressure and temperature as the gas 124 in the interior of enclosure 122.

Figure 4:
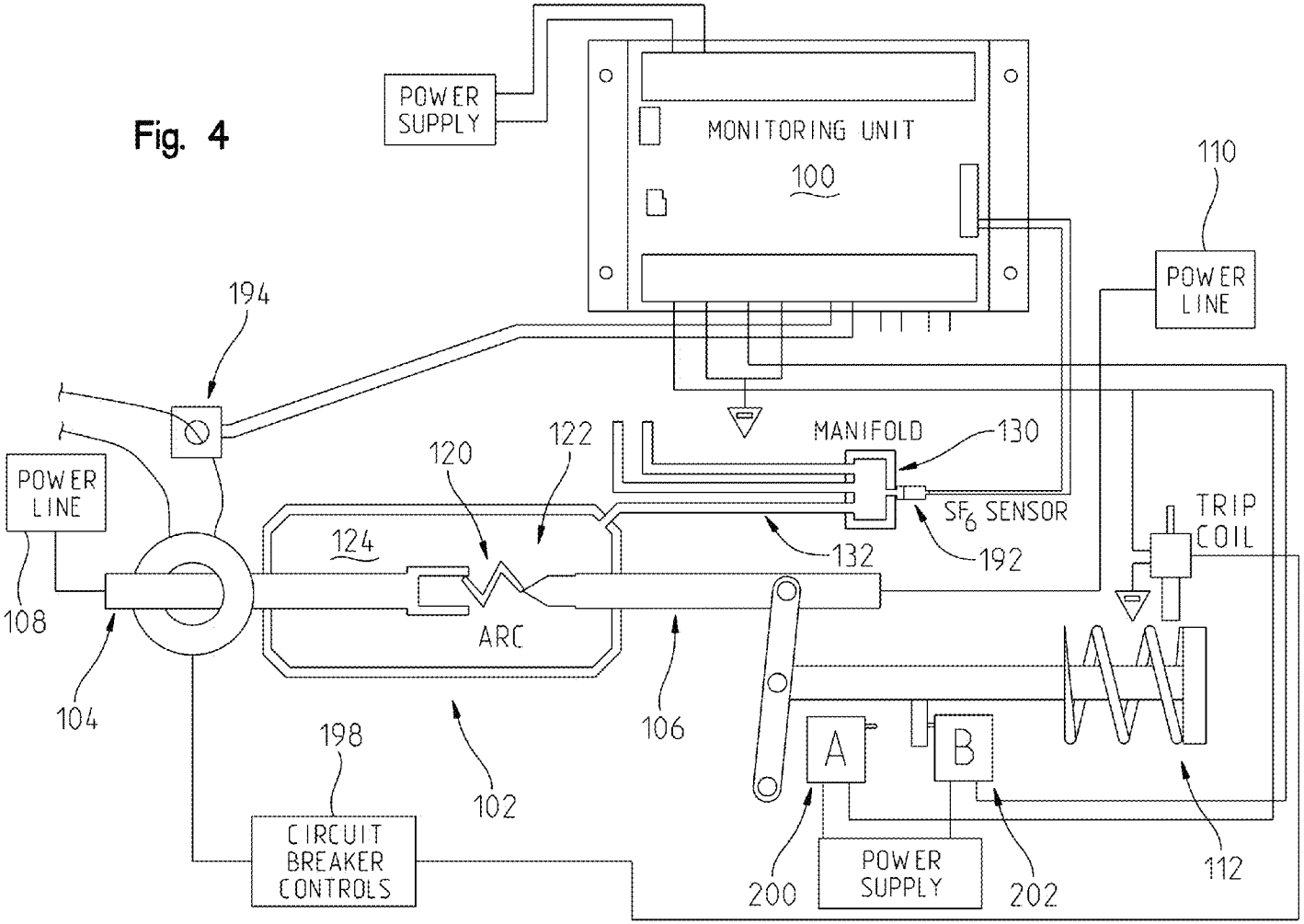
FIG. 4 is a representative view of the circuit breaker of FIG. 3A having an embodiment of the monitoring unit of FIGS. 1A and 1B coupled thereto.

Referring to FIG. 4, gas sensor 192 is monitored by monitoring system 100. Based on the output of gas sensor 192, monitoring system 100 determines one or more characteristics of the gas 124 in enclosure 122. In one embodiment, monitoring system 100 further monitors the one or more characteristics of the current flowing between first power line 108 and second power line 110. Monitoring system 100 based on the one or more characteristics of the gas 124 in enclosure 122 determines one or more characteristics about circuit breaker 102. In one embodiment, monitoring system 100 based on the one or more characteristics of the gas 124 in enclosure 122 and the one or more characteristics of the current flowing between first power line 108 and second power line 110 determines one or more characteristics about circuit breaker 102. Exemplary characteristics of circuit breaker 102 include trip time (see FIG. 15), travel time (see FIG. 15), arc time (see FIG. 15), clearing time (see FIG. 15), restrike (see FIG. 15), $I^2T$ duty (see FIG. 15), $I^nT$ duty, and/or IT duty. These characteristics are determined by monitoring system 100 based on input from current sensor 194, first switch 200, and second switch 202. Additional details regarding these characteristics and the operation of an exemplary embodiment of monitoring system 100 are provided in U.S. Provisional Application Ser. No. 61/448,585, the disclosure of which is expressly incorporated by reference herein.

Returning to FIGS. 1A and 1B, monitoring system 100 includes an enclosure 140 housing a controller 142. An exemplary controller is a Cirrus Logic EP9312 microprocessor. Controller 142 has access to a memory 144. Controller 142 executes software 146 stored on the memory 144. Memory 144 is a computer readable medium and may be a single storage device or may include multiple storage devices, located either locally with controller 142 or accessible across a network. Computer-readable media may be any available media that may be accessed by controller 142 and includes both volatile and non-volatile media. Further, computer readable-media may be one or both of removable and non-removable media. By way of example, computer-readable media may include, but is not limited to, RAM, ROM, EEPROM, flash memory or other memory technology, CD-ROM, Digital Versatile Disk (DVD) or other optical disk storage, magnetic cassettes, magnetic tape, magnetic disk storage or other magnetic storage devices, or any other medium which may be used to store the desired information and which may be accessed by controller 142.

In one embodiment, operational software 146 includes communication software for handling data transfer between controller 142 and other devices, such as portable memory device 150 and remote computing device 152. Exemplary remote computing devices include personal electronic devices, smartphones, laptops, desktops, and other suitable computing devices. In the illustrated embodiment, portable memory device 150 is a device including a memory 154, a controller 156, and a universal serial bus ("USB") connector 158. The USB connector 158 interfaces with a USB connector 160 accessible from an exterior of enclosure 140 to permit the communication of information from one of controller 142 and controller 156 to the other of controller 142 and controller 156. In one embodiment, information stored in memory 154 is uploaded to controller 142 for execution and/or storage on memory 144. In one example, settings are uploaded to controller 142 so that multiple monitoring systems 100 have the same settings. In one embodiment, information stored in memory 144 is downloaded to memory 154 of portable memory device 150. Although a USB connection is illustrated other suitable types of connection between a portable memory device 150 and controller 142 may be utilized. In one embodiment, a technician carries a unique portable memory device 150 for each monitoring system 100.

Figure 2:
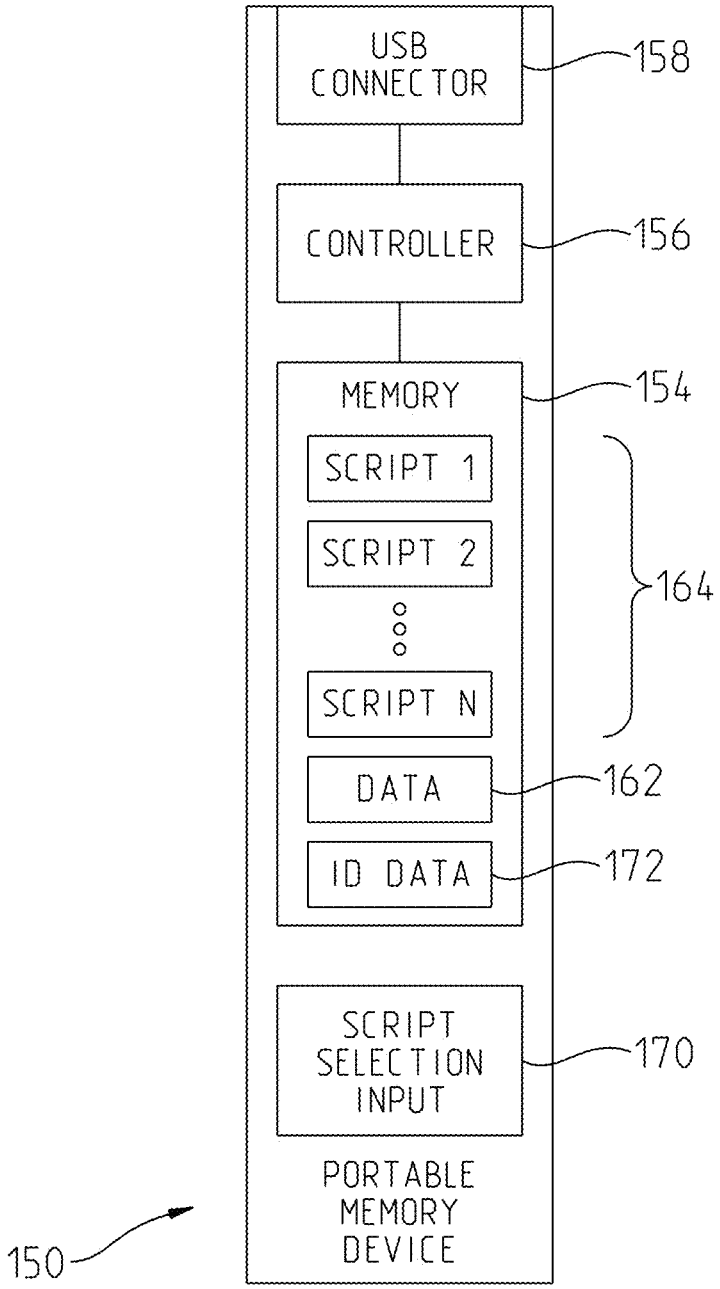
FIG. 2 is a representative view an exemplary portable memory device for use with the monitoring system of FIGS. 1A and 1B.

Referring to FIG. 2, memory 154 includes data 162 which has been downloaded from memory 144. Memory 154 further includes a plurality of scripts 164, one or more of which are executed by controller 142 when portable memory device 150 is connected to USB connector 160. An exemplary script is an "Alarm Reset" script which prompts controller 142 to reset all active alarms discussed herein associated with monitoring system 100 with the exception of an $I^2T$ duty Accumulation alarm, a Low Density alarm, and an Operations Count. Another exemplary script is an "IP Address Reset" script which prompts controller 142 to reset the IP address to a default value. In one embodiment, the default value is specified by the script. A further exemplary script uploads updates to operational software 146 to memory 144. In the illustrated embodiment, a settings file 166 is stored on memory 144 to store user settings for operational software 146. In this manner updates to operational software 146 do not alter any settings of settings file 166. An additional script downloads a configuration setting from memory 144 of a first monitoring unit 100 for subsequent uploading to another monitoring unit 100. In this manner, the second monitoring unit 100 is made a clone of the first monitoring unit 100.

In one embodiment, portable memory device 150 includes a script selection input 170 which is actuatable from an exterior of portable memory device 150. With script selection input 170, an operator may select the appropriate script to be executed by controller 142. In one embodiment, the script selection input has a plurality of settings each corresponding to a unique script. In one embodiment, memory 154 includes identification data 172 which is used to identify portable memory device 150 to controller 142. The script executed and the identity of the portable memory device 150 may be logged by controller 142 in a database, such as monitoring database 174, stored on memory 144 so that a record is kept of interactions with controller 142. In this manner, it is possible to determine who cleared alarms associated with monitoring system 100.

Returning to FIGS. 1A and 1B, in one embodiment, operational software 146 includes communication software for handling data transfer between controller 142 and remote computing device 152. In one embodiment, the data is transferred between monitoring system 100 and remote computing device 152 through a network. The network may be a wired network or a wireless network. Exemplary networks include a local area network, a wide area network, a public switched network, a CAN network, any type of wired network, and any type of wireless network. An exemplary public switched network is the Internet.

In one embodiment, controller 142 has an associated IP address which is accessible by remote computing device 152 through a network. In the illustrated embodiment, an RS-232 port 176 of monitoring system 100 is coupled to a local area network 177 and one or both of an RS-485 port 178 and an Ethernet port 180 is coupled to one or both of a local area network 177 and a wide area network 181. Remote computing device 152 is coupled to monitoring system 100 through one of local area network 177 and wide area network 181. In one example, one of local area network 177 and wide area network 181 has access to the Internet and remote computing device 152 couples to the one of local area network 177 and wide area network 181 through the Internet.

In one embodiment, the logged data in monitoring database 174 is made available to remote computing device 152 as formatted XML data through a web interface 182. The data may then be stored on a memory 184 associated with remote computing device 152.

Referring to FIGS. 1A and 1B, enclosure 140 also includes sensor connections 190. Sensor connections provide power to various sensors and receive output from the sensors. A first exemplary sensor is a gas sensor 192 which is positioned to monitor the gas 124 in the interior of enclosure 122. An exemplary gas sensor is a gas density sensor. An exemplary gas density sensor is TRAFAG model 8774 Digital SF6 Gas Density Sensor which is described in more detail in U.S. Provisional Application Ser. No. 61/448,585, the disclosure of which is expressly incorporated by reference herein. In one embodiment, the gas sensor is a true density sensor which reports density values as an output. In one embodiment, the gas sensor 142 provides an analog signal to monitoring system 100. In one embodiment, the gas sensor 192 provides a digital signal to monitoring system 100. In one embodiment, monitoring system 100 provides a universal gas sensor interface which allows analog sensors, pulse-width modulation (PWM) sensors, frequency modulation (FM) sensors, PWM with FM sensors, digital sensors, and switch type sensors connected to the same terminals on monitoring system 100. A second exemplary sensor is a current sensor 194 which monitors the current passing through circuit breaker 102. An exemplary current sensor 194 is shown in FIG. 4. As shown in FIG. 4, current sensor 194 is a secondary current transformer (Pickup Coil) which monitors a current induced on a primary (bushing) current transformer due to a current flowing between first power line 108 and second power line 110. Additional exemplary sensors include vibration sensors, accelerometers, gas impurity sensors, weather sensors, lightning sensors, partial discharge sensors, infrared sensors, hall effect sensors, dissolved gas analysis sensors, and other suitable sensors.

Returning to FIGS. 1A and 1B, monitoring system 100 further includes switch connections 196 which connect to a first switch 200 and a second switch 202. Switches 200 and 202 monitor the position of plunger system 112. Referring to FIG. 4, monitoring system 100 further monitors the state of switch A 200 (Aux A in FIG. 15) and switch B 202 (Aux B in FIG. 15) to provide an indication of the state of circuit breaker 102.

Figure 5:
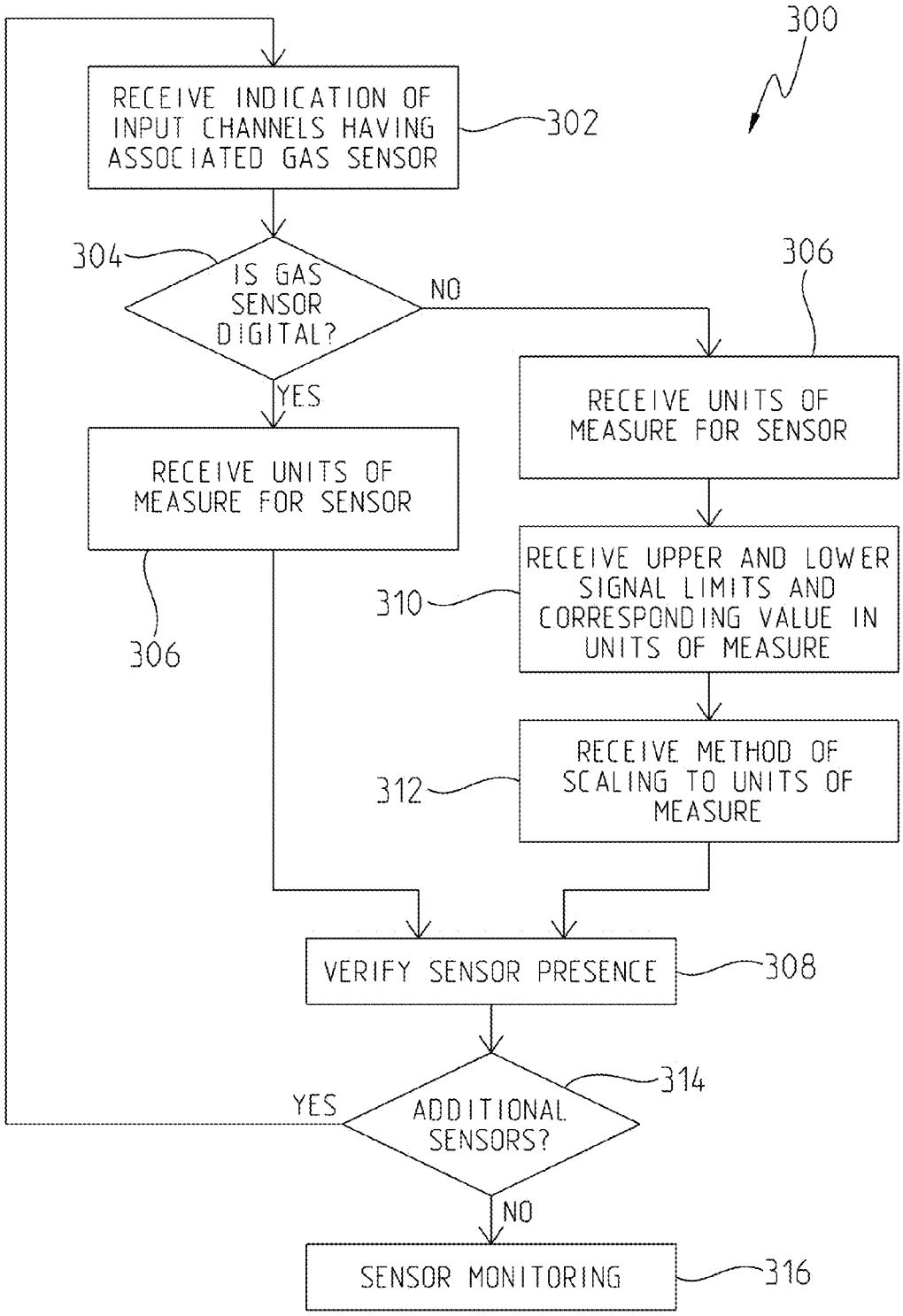
FIG. 5 is an exemplary processing sequence of the monitoring unit of FIGS. 1A and 1B related to sensor setup.

Turning to FIG. 5, an exemplary processing sequence 300 of operational software 146 is illustrated. Processing sequence 300 relates to the setup of gas sensor 192. Controller 142 receives an indication that a pair of input connections of sensor connections 190 have a gas sensor 192 connected thereto, as represented by box 302. In one embodiment, the indication is provided from portable memory device 150 or remote computing device 152. Controller 142 determines based on the received information whether the gas sensor 192 is a digital sensor or an analog sensor, as represented by block 304. If the sensor is indicated to be a digital sensor, controller 142 determines based on the received information the units of measure for the sensor, as represented by block 306. This information is stored in memory 144 for use in future calculations based on the sensor output. The controller 142 next verifies the presence of the sensor, as represented by block 308. In one embodiment, the controller 142 checks to see if a signal is being provided by the sensor.

If the sensor is an analog sensor, controller 142 determines based on the received information the units of measure for the sensor, as represented by block 306. This information is stored in memory 144 for use in future calculations based on the sensor output. The controller 142 next determines based on the received information the upper and lower signal limits of the sensor and the corresponding value of the limits in a unit of measure, as represented by block 310. The controller also determines based on the received information the method of scaling from the sensor signal to the unit of measure, as represented by block 312. In the same manner as digital sensors, controller 142 next verifies the presence of the sensor, as represented by block 308. In one embodiment, the controller 142 checks to see if a signal is being provided by the sensor. If there are no additional sensors, controller 142 moves onto a sensor monitoring mode of operation, as represented by blocks 314 and 316.

Figure 6:
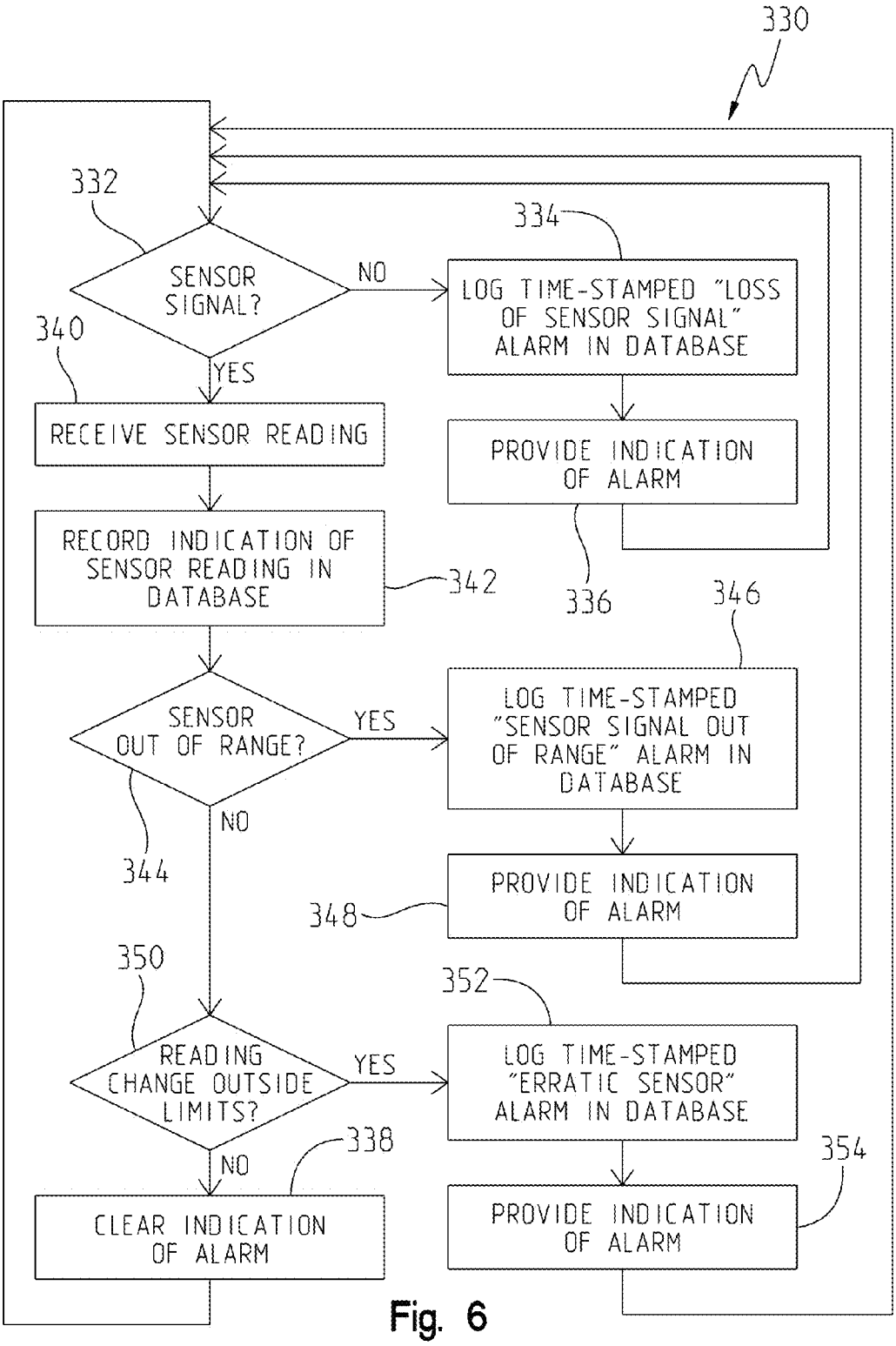
FIG. 6 is an exemplary processing sequence of the monitoring unit of FIGS. 1A and 1B related to sensor alarms.

Turning to FIG. 6, an exemplary processing sequence 330 of operational software 146 is illustrated. Processing sequence 330 relates to the sensor malfunction conditions of gas sensor 192. Processing sequence 330 is run for all connected sensors 192 and is explained in connection with a single sensor 192. Controller 142 determines if a signal is being received from the sensor 192, as represented by block 332. If a signal is not being received, a time-stamped "LOSS OF SENSOR SIGNAL" alarm is logged in monitoring database 174, as represented by block 334. Controller 142 provides an indication of the alarm, as represented by block 336. Exemplary indications include visual indications at the location of monitoring system 100, audio indications at the location of monitoring system 100, an alert sent to remote computing device 152, and other exemplary indicators. In one embodiment, a relay shall close and an indicator 196 will be activated. In one embodiment, the relay closing causes monitoring system 100 to provide a remote notification. In one example, a system is monitoring the state of the relay. Exemplary systems include a supervisory control and data acquisition (SCADA) system and a data acquisition remote terminal unit. An exemplary indicator 196 is a LED 199 on a face of monitoring system 100 shall light up (see FIG. 16). As represented by block 338, if during the next cycle the sensor signal returns, the LED will be deactivated and the relay shall open, but the time-stamped record of the alarm shall remain in monitoring database 174.

If a sensor signal is provided, controller 142 receives the sensor reading, as represented by block 340, and records an indication of the sensor reading in monitoring database 174, as represented by block 342. In one embodiment, the raw sensor reading is recorded in monitoring database 174. In one embodiment, a density value and a temperature value based on the raw sensor reading is recorded in monitoring database 174. The controller 142 determines if the sensor reading is out of range, as represented by block 344. If the sensor reading is out of range, a time-stamped "SENSOR SIGNAL OUT OF RANGE" alarm is logged in monitoring database 174, as represented by block 346. Controller 142 provides an indication of the alarm, as represented by block 348. Exemplary indications include visual indications at the location of monitoring system 100, audio indications at the location of monitoring system 100, an alert sent to remote computing device 152, and other exemplary indicators. In one embodiment, a relay shall close causing monitoring system 100 to provide a remote notification and an indicator 196 will be activated. An exemplary indicator 196 is a LED 199 on a face of monitoring system 100 shall light up (see FIG. 16). As represented by block 338, if during the next cycle the sensor signal is in range, the LED 199 shall turn off and the relay shall open, but the time-stamped record of the alarm shall remain in monitoring database 174.

If the sensor reading is in range, the controller 142 determines if the sensor reading change from prior readings is within limits, as represented by block 350. If the sensor reading change is outside of the limits, a time-stamped "ERRATIC SENSOR" alarm is logged in monitoring database 174, as represented by block 352. In one embodiment, an erratic sensor alarm is set when the density measurements (examines multiple samples) deviate up and down by a significant amount, but the average (mean) of the samples does not show a significant (typically downward) trend. Controller 142 provides an indication of the alarm, as represented by block 354. Exemplary indications include visual indications at the location of monitoring system 100, audio indications at the location of monitoring system 100, an alert sent to remote computing device 152, and other exemplary indicators. In one embodiment, a relay shall close causing monitoring system 100 to provide a remote notification and an indicator 196 will be activated. An exemplary indicator 196 is a LED 199 on a face of monitoring system 100 shall light up (see FIG. 16). As represented by block 338, if during the next cycle the sensor signal is in range, the LED 199 shall turn off and the relay shall open, but the time-stamped record of the alarm shall remain in monitoring database 174.

In one embodiment, controller 142 causes for each sensor 192 the present density (& temperature) "MEASUREMENTS" to be recorded in monitoring database 174 as a status log at regular intervals. In one embodiment, the interval may be set between two hours to twenty-four hours. The interval time may be a user selected parameter specified in settings file 166. In one embodiment, monitoring database 174 maintains about 5000 records in the status log of monitoring database 174. When the status log is filled, the oldest data entries shall be deleted following a first-in first-out methodology.

Controller 142 examines the recorded data to determine if a "LOW DENSITY WARNING" or a "LOW DENSITY ALARM" is present. In one embodiment, if a first threshold number of consecutive "MEASUREMENTS" for a sensor is equal to or below a first programmed threshold value, a "LOW DENSITY WARNING" will be logged in monitoring database 174, and an indicator 196 will be activated. An exemplary indicator 196 is the LED 199 on a face of monitoring system 100 which shall light up (see FIG. 16). If a second threshold number (greater than the first number) of consecutive "MEASUREMENTS" for a sensor is equal to or below a first programmed threshold value, a "LOW DENSITY ALARM" will be logged in monitoring database 174, the LED 199 on a face of monitoring system 100 shall light up (see FIG. 16), and the relay will be closed. Unlike the sensor malfunction alarms, the "LOW DENSITY WARNING" or a "LOW DENSITY ALARM" will not result in the LED 199 and the relay to reset even if the density returns to a level above the first programmed threshold value. In one embodiment, the first threshold number is three.

Figure 7:
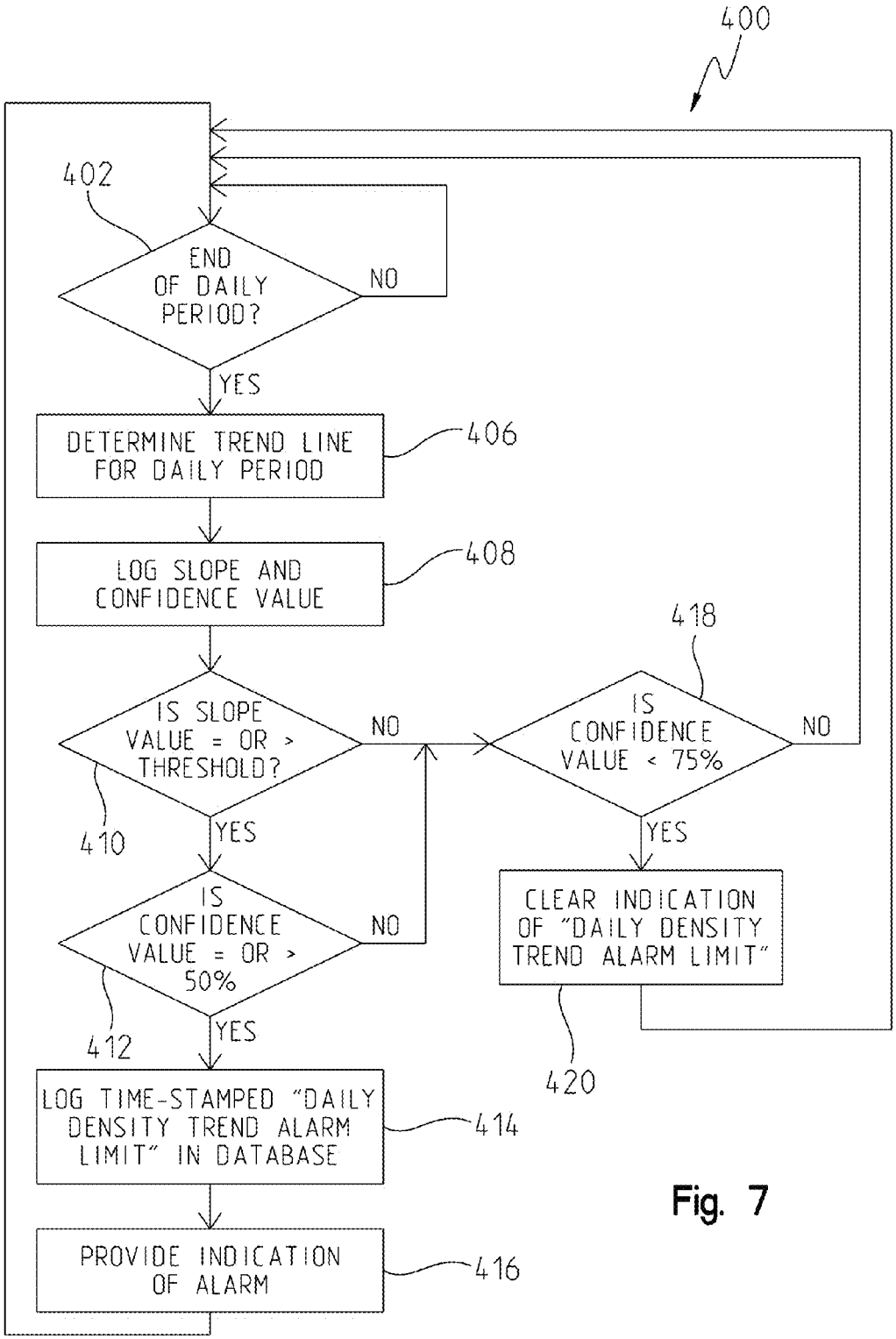
FIG. 7 is an exemplary processing sequence of the monitoring unit of FIGS. 1A and 1B related to daily density alarms.

Turning to FIG. 7, an exemplary processing sequence 400 of operational software 146 is illustrated. Processing sequence 400 relates to Density Trend Calculation & Alarms of gas sensor 192. Processing sequence 400 is run for all connected sensors 192 and is explained in connection with a single sensor 192. Controller 142 determines if the calculation period has ended, as represented by block 402. In the illustrated embodiment, the calculation period is an hour. Other calculation periods may be used. During the calculation period, time-stamped values of density and temperature are recorded in a minute array 404 (see FIGS. 1A and 1B) in memory 144. In the illustrated embodiment, time-stamped values of density and temperature are recorded every minute.

If the calculation period has ended, a trend line is determined for the calculation period as represented by block 406. In one embodiment, the trend line is a best fit line to the sensor density values. Time-stamped values of the slope of the trend line and a fit characteristic or confidence factor of the trend line are recorded in monitoring database 174, as represented by block 408. Controller 142 determines if the recorded slope is equal to or greater than a programmed Daily Density Trend Alarm Limit. If the recorded slope is equal to or greater than the limit (meaning the gas density is decaying at an unacceptable rate), represented by block 410, and the Confidence Level is 50% or higher (meaning the gas density meets a first measure of linearity), represented by block 412, a "DAILY DENSITY TREND ALARM" will be logged in monitoring database 174, as represented by block 414. Controller 142 provides an indication of the alarm, as represented by block 416. Exemplary indications include visual indications at the location of monitoring system 100, audio indications at the location of monitoring system 100, an alert sent to remote computing device 152, and other exemplary indicators. In one embodiment, a relay shall close causing monitoring system 100 to provide a remote notification and a LED 199 on a face of monitoring system 100 shall light up (see FIG. 16). As represented by blocks 418 and 420, if the slope of a subsequent trend line for the sensor 192 is less than the Daily Density Trend Alarm Limit or the Confidence Level of the subsequent trend line is lower than 75%, the LED 199 shall turn off and the relay shall open, but the time-stamped record of the alarm shall remain in monitoring database 174.

Figure 8:
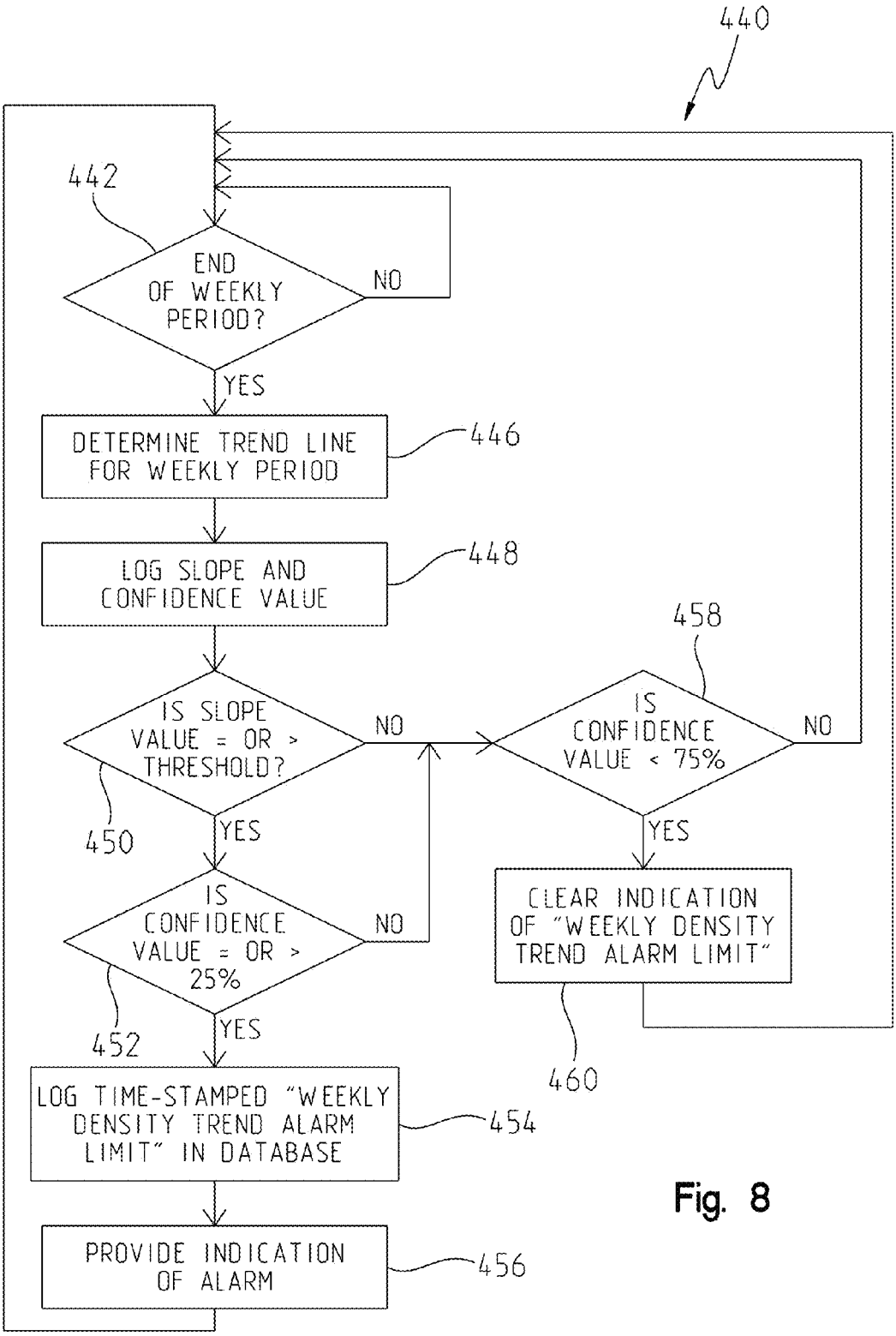
FIG. 8 is an exemplary processing sequence of the monitoring unit of FIGS. 1A and 1B related to periodic density alarms, such as weekly or monthly.

Turning to FIG. 8, an exemplary processing sequence 440 of operational software 146 is illustrated. Processing sequence 440 also relates to Density Trend Calculation & Alarms of gas sensor 192, but over a longer time period. Processing sequence 440 is run for all connected sensors 192 and is explained in connection with a single sensor 192. Controller 142 determines if the calculation period has ended, as represented by block 442. In the illustrated embodiment, the calculation period is one of a week and a month (a week is illustrated). Other calculation periods may be used. During the calculation period, time-stamped values of density and temperature are recorded in an hour array 444 (see FIGS. 1A and 1B) in memory 144. In the illustrated embodiment, time-stamped values of density and temperature are recorded every hour.

In one embodiment, at spaced apart time intervals (as an example every day), monitoring system 100 determines an average density for each time period and then determines a mass of the gas in enclosure 122 for that time period by multiplying the volume of the enclosure 122 by the average density. By accumulating the mass loss over a plurality of time periods, a mass loss across the multiple time periods may be determined.

If the calculation period has ended, a trend line is determined for the calculation period as represented by block 446. In one embodiment, the trend line is a best fit line to the sensor density values. Time-stamped values of the slope of the trend line and a fit characteristic or confidence factor of the trend line are recorded in monitoring database 174, as represented by block 448. Controller 142 determines if the recorded slope is equal to or greater than a programmed Weekly Density Trend Alarm Limit. If the recorded slope is equal to or greater than the limit (meaning the gas density is decaying at an unacceptable rate), represented by block 450, and the Confidence Level is 25% or higher (meaning the gas density meets a first measure of linearity), represented by block 452, a "WEEKLY DENSITY TREND ALARM" will be logged in monitoring database 174, as represented by block 454. Controller 142 provides an indication of the alarm, as represented by block 456. Exemplary indications include visual indications at the location of monitoring system 100, audio indications at the location of monitoring system 100, an alert sent to remote computing device 152, and other exemplary indicators. In one embodiment, a relay shall close causing monitoring system 100 to provide a remote notification and a LED 199 on a face of monitoring system 100 shall light up (see FIG. 16). As represented by blocks 458 and 460, if the slope of a subsequent trend line for the sensor 192 is less than the Weekly Density Trend Alarm Limit or the Confidence Level of the subsequent trend line is lower than 75%, the LED 199 shall turn off and the SF6 relay shall open, but the time-stamped record of the alarm shall remain in monitoring database 174.

Figure 9:
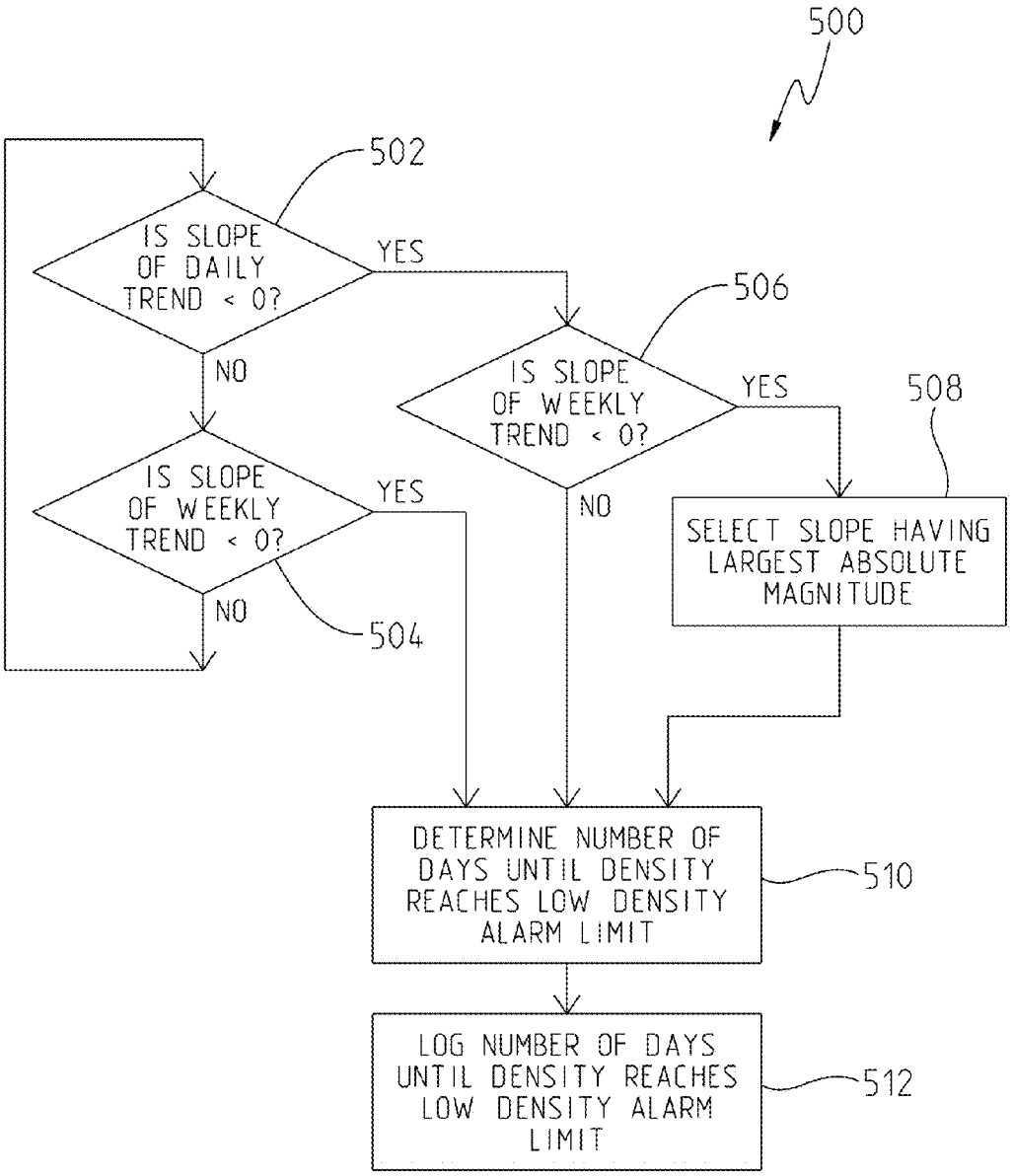
FIG. 9 is an exemplary processing sequence of the monitoring unit of FIGS. 1A and 1B related to low density alarm forecasting.

Turning to FIG. 9, an exemplary processing sequence 500 of operational software 146 is illustrated. Processing sequence 500 also relates to Low Density Alarm Forecast of gas sensor 192. Processing sequence 500 is run for all connected sensors 192 and is explained in connection with a single sensor 192. When a slope value for a current trend line of processing sequence 400 has been determined, controller determines if the slope value is negative, as represented by block 502. Controller 142 also determines if the slope value for the current trend line of processing sequence 440 is negative, as represented by blocks 504 and 506. If the slope value of the current trend line of processing sequence 400 and the slope value of the current trend line of processing sequence 440 are both negative, the most negative slope is selected, as represented by block 508. Once one of the slope value of the current trend line of processing sequence 400 and the slope value of the current trend line of processing sequence 440 is selected, controller 142 determines a number of days until the current density decays to "LOW DENSITY ALARM LIMIT", as represented by block 510. The number of days is logged into monitoring database 174, as represented by block 512. In one embodiment, the number of days is also reported to remote computing device 152.

Figure 10:
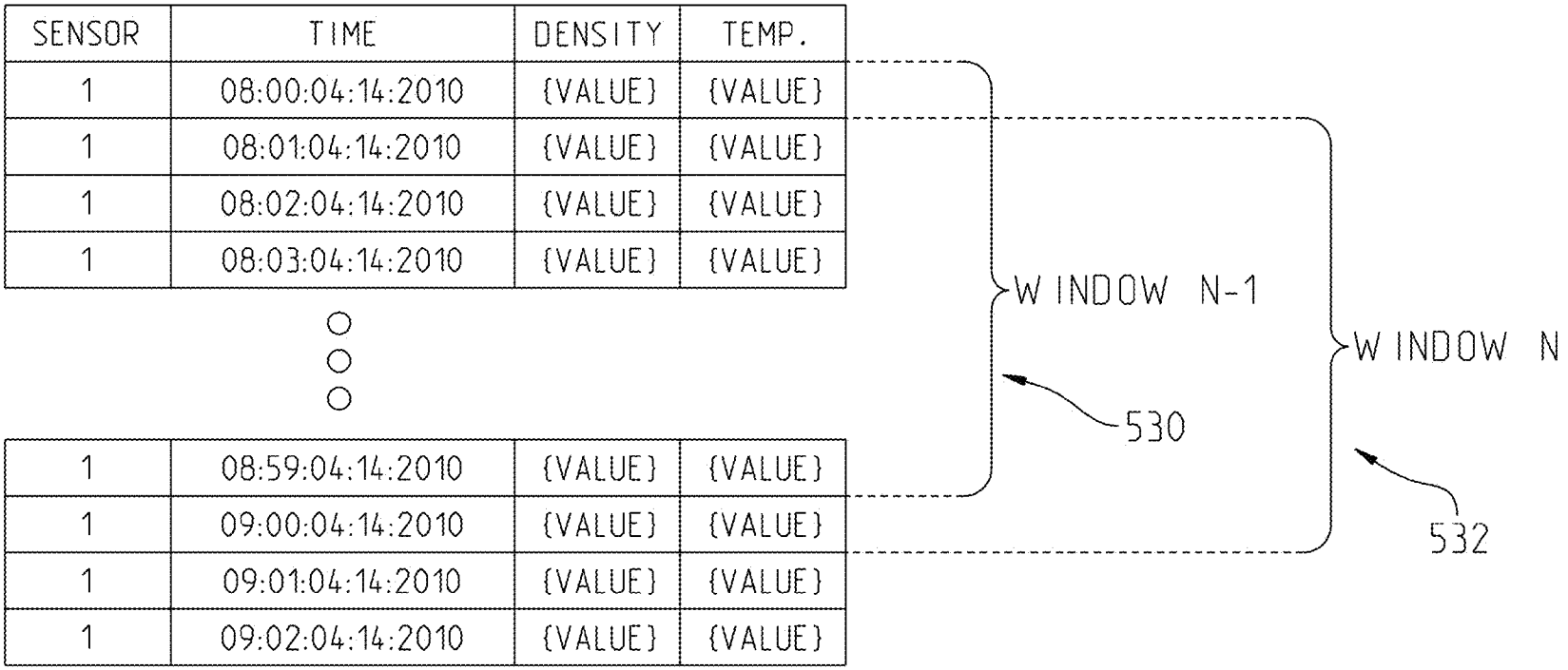
FIG. 10 is an exemplary array of sensor values of the monitoring unit of FIGS. 1A and 1B.

Turning to FIG. 10, an exemplary representation of the minute array 414 for a first sensor 192 is shown. A first window 520 includes the density values from 8:00 to 8:59 (one hour) and a second window 532 is shifted forward by a minute and includes density values from 8:01 to 9:00 (one hour).

Figure 11:
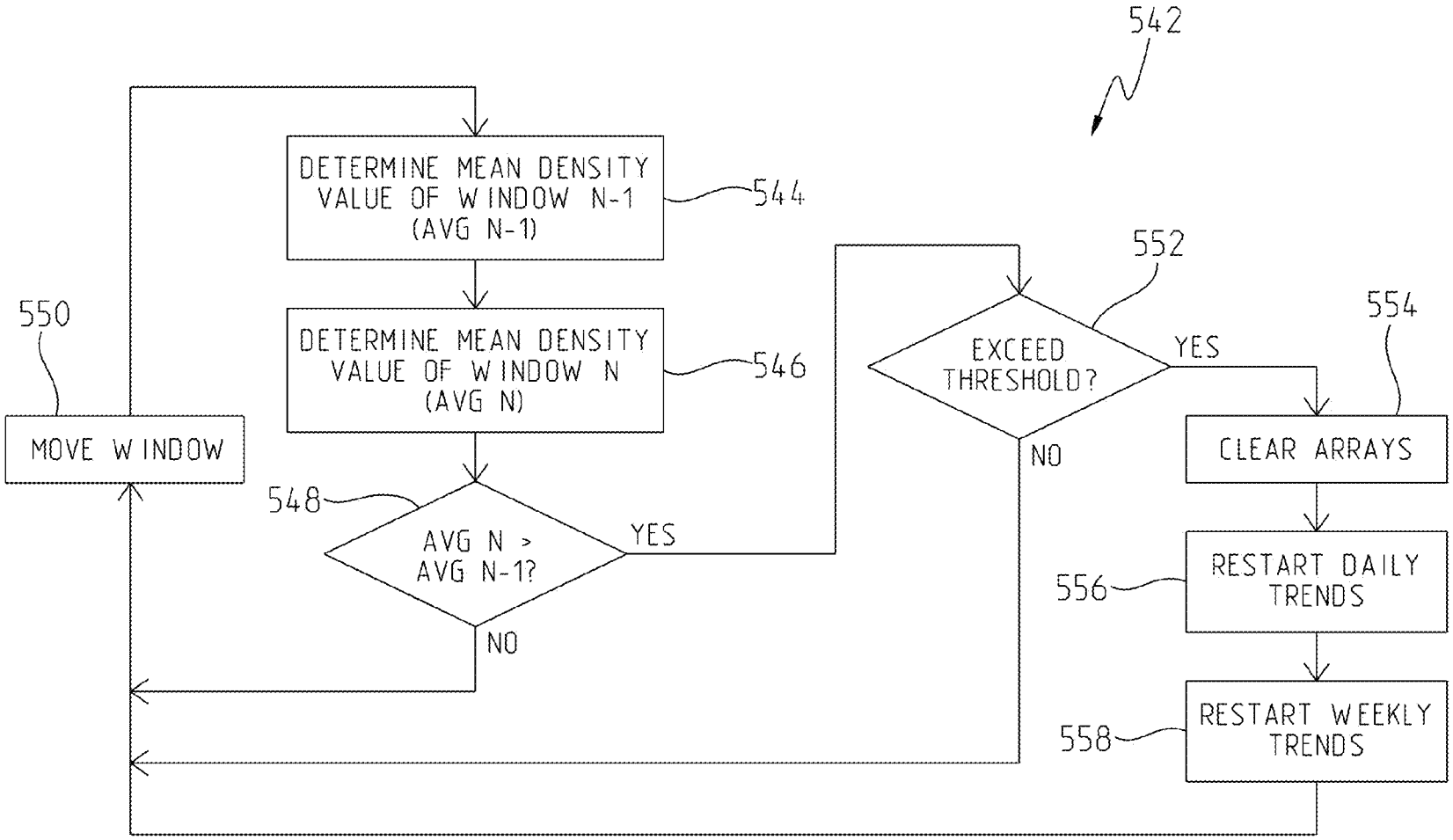
FIG. 11 is an exemplary processing sequence of the monitoring unit of FIGS. 1A and 1B related to sensor data management.

Referring to FIG. 11, an exemplary processing sequence 540 of operational software 146 is illustrated. Processing sequence 540 relates to Increasing Density of gas sensor 192. Processing sequence 540 is run for all connected sensors 192 and is explained in connection with a single sensor 192. A mean density for the members of window 530 is determined by controller 142, as represented by block 544. A mean density for the members of window 532 is determined by controller 142, as represented by block 546. Controller 142 determines if the mean value of window 532 is greater than the mean density value of window 530, as represented by block 548. If not, the windows are moved, as represented by block 550. In one embodiment, window 532 is the new window 530 and a new window 532 includes density values from 8:02 to 9:01 (one hour). If the mean value of window 532 is greater than the mean density value of window 530, the amount of the difference is compared to a threshold value, as represented by block 552. If the threshold is exceeded, the minute array 404 and hour array 444 are cleared and the trend lines of processing sequence 400 and processing sequence 440 are restarted, as represented by blocks 554, 556, and 558. One reason the gas density may increase is that additional gas is introduced into the interior of enclosure 122 during a fill event.

Figure 12:
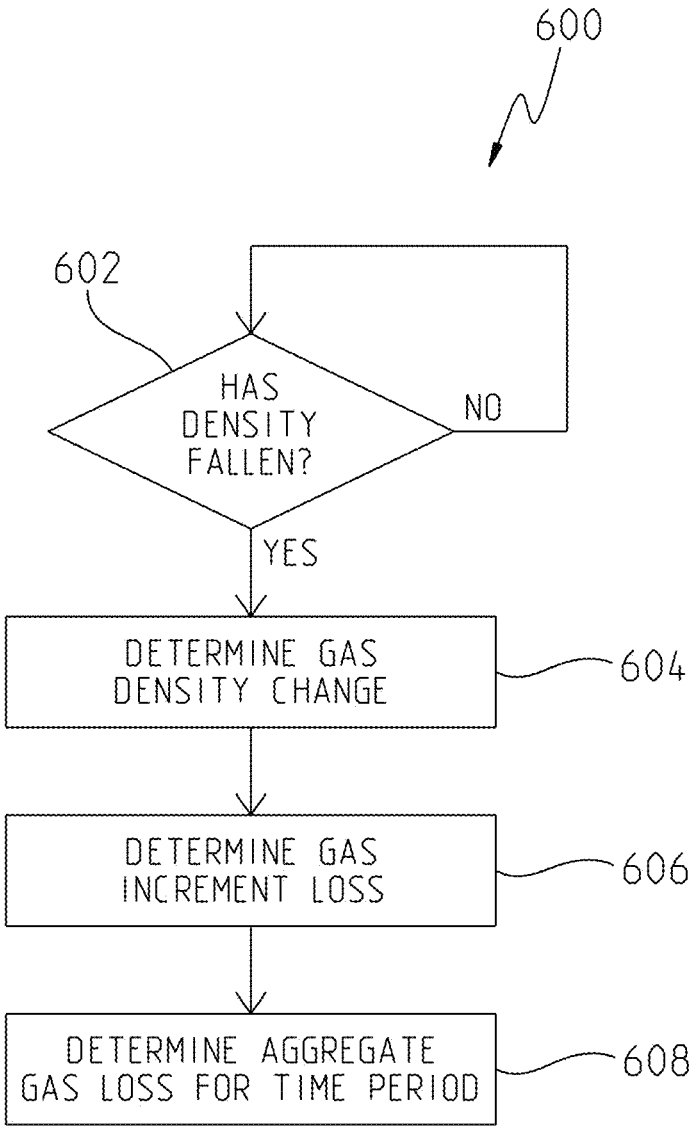
FIG. 12 is an exemplary processing sequence of the monitoring unit of FIGS. 1A and 1B related to gas loss management.

Referring to FIG. 12, an exemplary processing sequence 600 of operational software 146 is illustrated. Processing sequence 600 relates to determining an aggregate gas loss for a given time period. Processing sequence 540 is run for all connected sensors 192 and is explained in connection with a single sensor 192. A determination is made of whether the density for a sensor 192 has fallen, as represented by block 602. In one embodiment, the determination is whether the density for a sensor 192 has fallen at least by a threshold amount. If the density has fallen, the change in density is determined, as represented by block 604. Based on the change in density and a knowledge of the volume of enclosure 122 and the environmental conditions, an amount of gas loss may be determined, as represented by block 606. In one embodiment, the system is provided with or otherwise determines an initial fill mass of the gas in the enclosure 122 and uses a true density sensor to read an initial density reading. The amount of gas loss is determined by taking the initial fill mass times the quantity one minus the ratio of the current density to the initial density. This amount of gas loss is summed with prior gas loss amounts for a given time period to determine an aggregate gas loss for the time period, as represented by block 608. In one embodiment, the aggregate gas loss may be monitored for a plurality of time periods. Exemplary time periods include, daily, weekly, monthly, quarterly, and annually.

In one embodiment, the following data was logged by monitoring system 100. Once a minute the Minute Array is appended. Once an hour the Hour Array is appended, a Daily Density Trend is determined; a Daily Trend Confidence Level is determined; and a Low Density Alarm Forecast is determined. Once per day the Weekly or Monthly Density Trend is determined and a Weekly/Monthly Trend Confidence Level is determined. A Status Log is determined at a given interval (exemplary intervals being every 2-24 hours); a Present Density is determined; a Present Temperature (if available) is determined; a Present Daily Density Trend is determined; a Present Daily Trend Confidence Level is determined; a Present Weekly/Monthly Density Trend is determined; and a Present Weekly/Monthly Trend Confidence Level is determined.

In addition, the occurrence and time information (Date and Time) of the following alarms are logged: Loss of Sensor Signal Alarm, Sensor out of Range Alarm, Erratic Sensor Alarm, Daily Density Alarm including Daily Density Trend and Daily Trend Confidence Level, Weekly/Monthly Density Alarm. In one embodiment, monitoring system 100 has an associated printer 191 through which an operator may obtain log reports, an SF6 report, and alarm reports, and other suitable reports. Exemplary information in the SF6 report may include a measure of SF6 mass loss from the enclosure.

Figure 13:
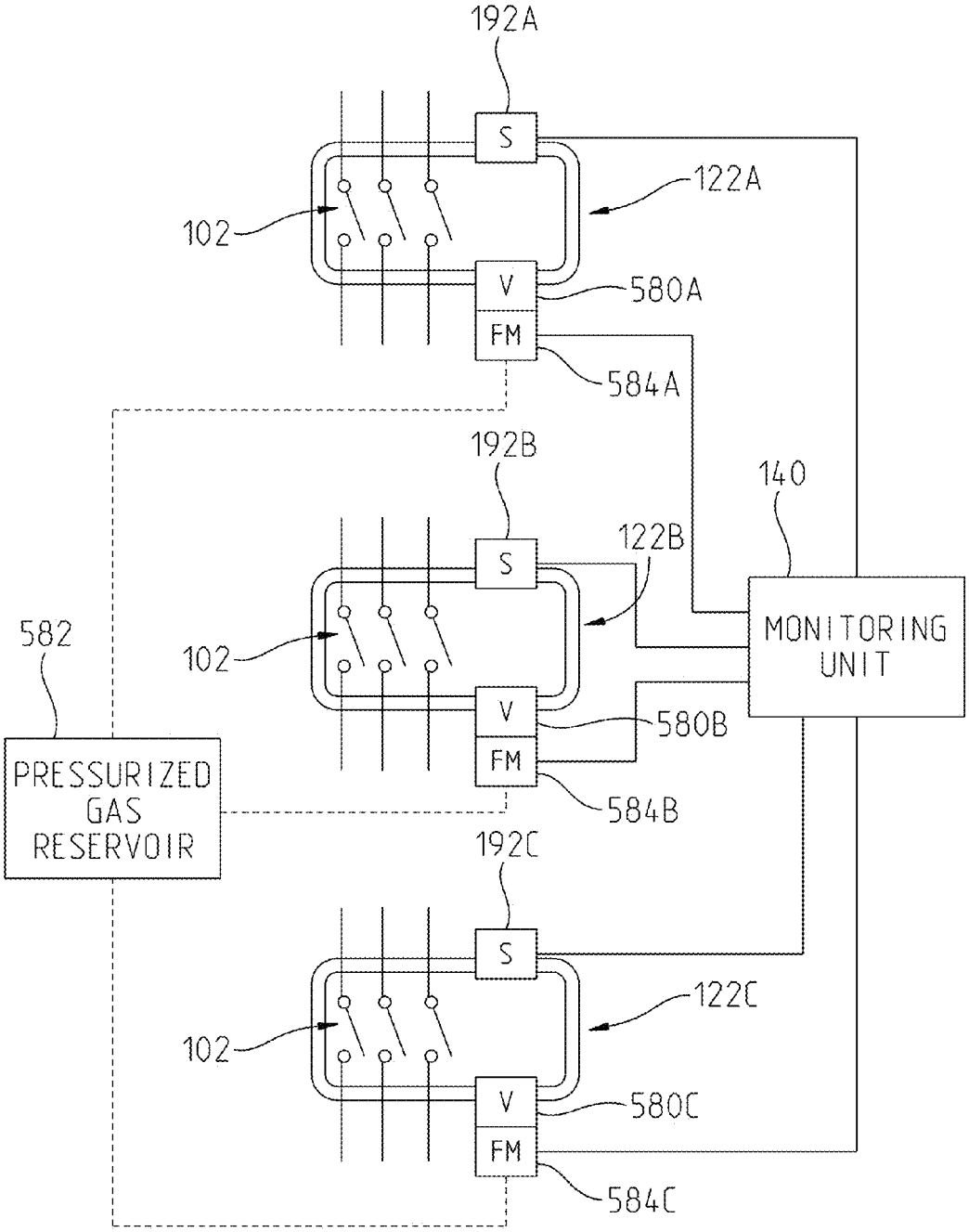
FIG. 13 is an exemplary gas refill arrangement for an embodiment of the monitoring system of FIGS. 1A and 1B.

Referring to FIG. 13, an exemplary gas refill arrangement for an embodiment of the monitoring system 100 is shown. The monitoring system 100 is connected to three sensors 192A-C, each of which monitors the gas in an interior of a respective enclosure 122A-C. Enclosures 122A-C are not in fluid communication with each other. In one embodiment, a single circuit breaker is provided for each enclosure 122. In one embodiment, a plurality of circuit breakers 102 are provided within a common gas volume, such as a plurality of enclosures 122 connected with a manifold.

In the embodiment, shown in FIG. 13, each of enclosures 122A-C includes a respective fluid valve 580A-C. Fluid valve 580 has a first configuration bringing the interior the enclosure 122 in fluid communication with a device connected to valve 580 and a second configuration wherein the interior of the enclosure 122 is not in fluid communication with a device connected to valve 580. In one embodiment, valve 580 is a manually actuated valve. In one embodiment, valve 580 is controlled by controller 142 of monitoring system 100.

A pressurized gas reservoir 582 may be coupled to each of valves 580A-C. The pressurized gas reservoir 582 provides additional gas to the interior of the enclosure 122 to which it is coupled (when valve 580 is in the first configuration) to increase the density of the gas within the interior of the enclosure 122.

A respective volumetric flowmeter 584A-C is coupled to each of valves 580A-C. The volumetric flowmeter 584 associated with the valve 580 to which the pressurized gas reservoir is coupled monitors an amount of gas that is flowing from the pressurized gas reservoir to the interior of the enclosure 122. This provides the operator with the amount of gas that has been delivered to the enclosure 122. In one embodiment, the volumetric flowmeter 584 provides an indication of the amount of gas that has been delivered to the enclosure to the controller 142 of monitoring system 100. In this manner, monitoring system 100 is able to track the amount of gas delivered to the enclosures 122A-C it is monitoring. In one embodiment, this information is stored in monitoring database 174. An exemplary volumetric flowmeter is the TS-VFM flow meter available from Franklin Fueling Systems located in Madison, Wis. In one embodiment, if the volume of enclosure 122 is known, then monitoring a change in gas density in enclosure 122 during delivery of gas may be used to determine the amount of gas delivered to the enclosure 122.

Figure 14:
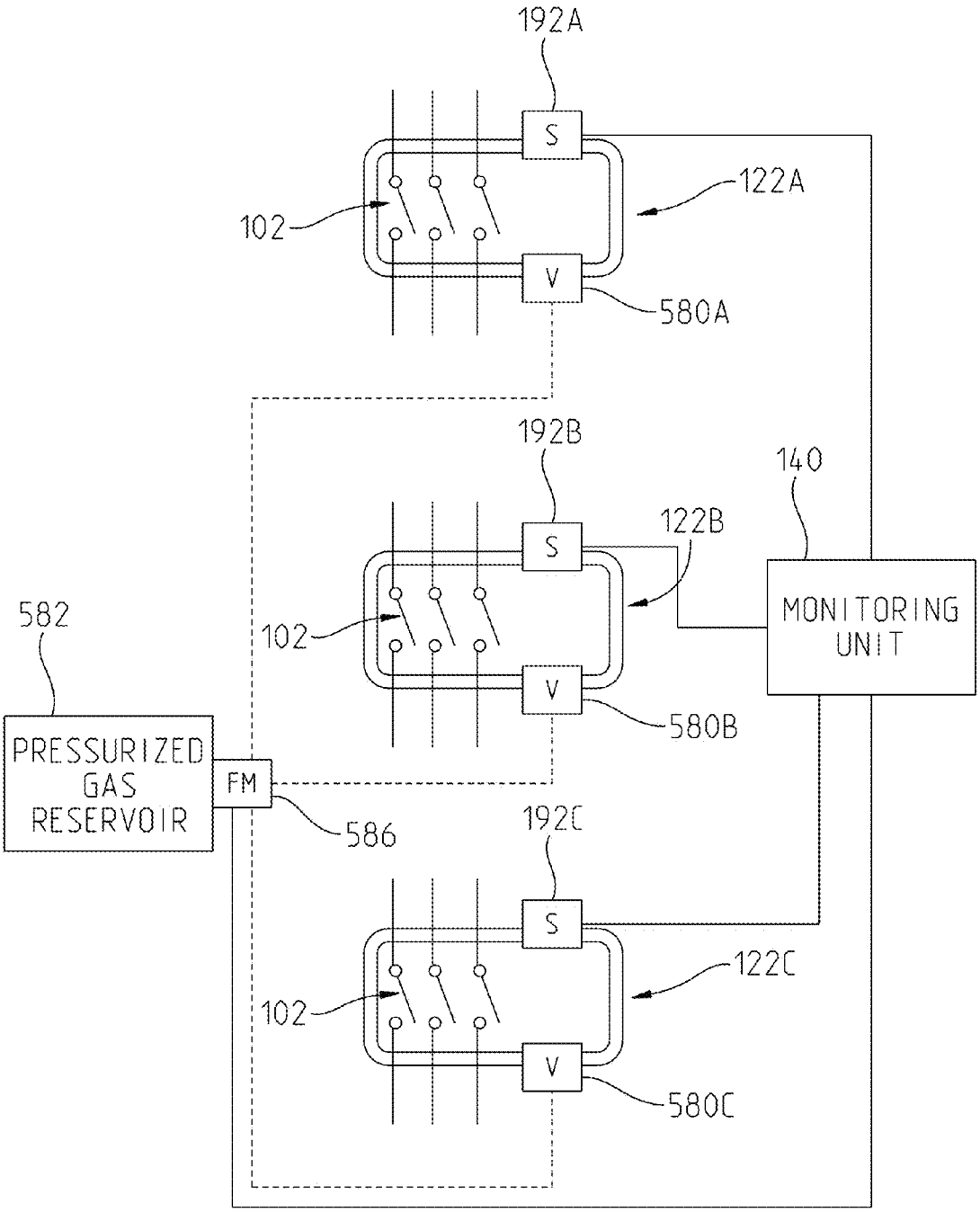
FIG. 14 is another exemplary gas refill arrangement for an embodiment of the monitoring system of FIGS. 1A and 1B.

Referring to FIG. 14, in one embodiment, instead of each enclosure 122 having an associated volumetric flowmeter 584, a single volumetric flowmeter 586 is associated with the pressurized gas reservoir 582. The volumetric flowmeter 586 monitors the amount of gas that exits the pressurized gas reservoir 582 for filling enclosure 122. In one embodiment, the volumetric flowmeter 586 provides an indication of the amount of gas that has been delivered to the controller 142 of monitoring system 100. In this manner, monitoring system 100 is able to track the amount of gas delivered to the enclosures 122A-C it is monitoring. In one embodiment, this information is stored in monitoring database 174.

In one embodiment, in addition to monitoring the gas density within enclosure 122, monitoring system 100 also monitors one or more characteristics of the current flowing from first power line 108 to second power line 110. In one embodiment, the current monitoring processes are described in U.S. Pat. No. 4,977,513, the disclosure of which is expressly incorporated by reference herein. An exemplary embodiment of the monitoring system 100 is provided in U.S. Provisional Application Ser. No. 61/448,585, the disclosure of which is expressly incorporated by reference herein.

Figure 15:
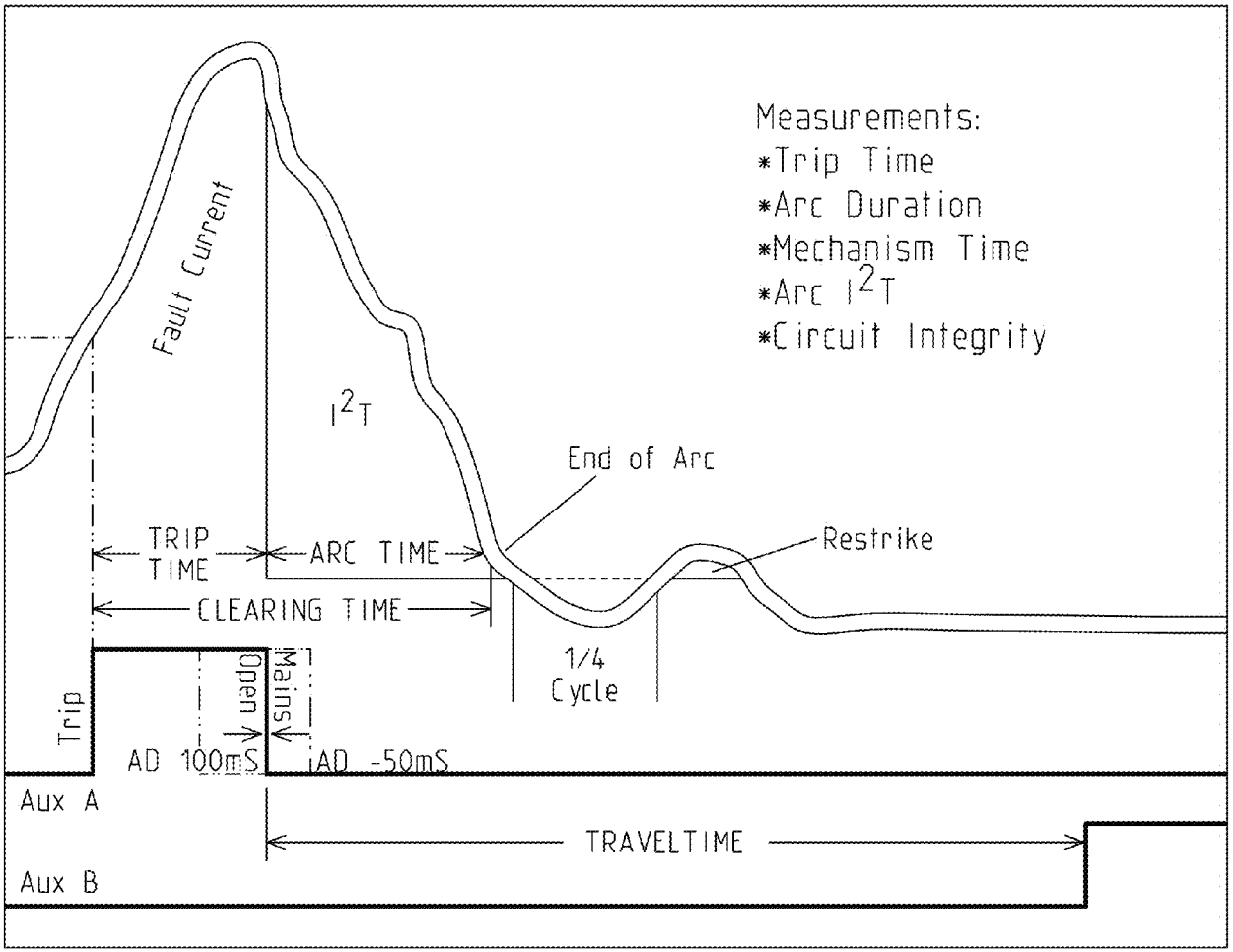
FIG. 15 is a representative view of current monitoring of the monitoring system of FIGS. 1A and 1B.

Referring to FIG. 15, a representative view of various parameters being monitored by monitoring system 100 is provided. The following parameters are monitored, each having its own alarm limit, by knowing when the trip coil is activated, monitoring the voltage of switches 200 and 202, and monitoring the current flowing between first power line 108 and second power line 110: Trip Time measurement, Arc time measurement (per phase), Clearing time measurement, Fault arc energy ($I^NT$, such as IT or $I^2T$) measurement and accumulation (per phase), Travel time measurement, Primary current measurement (per phase), Time since last circuit breaker operation, Restrike detection (per phase), Closing time measurement, and Aux input logic violation detection (switches 200 and 202 being in an incorrect state). The fault arc energy in one embodiment is the heat energy released during the arcing portion of the circuit interruption. In one embodiment, the fault arc energy characteristic is ($I^NT$ wherein N is in the range of about 1 to about 2), ($I^{1.4}T$), ($I^2T$), (IT), or other suitable arc characteristics.

Referring to FIG. 16, a plurality of exemplary visual indicators are provided. Exemplary visual indicators are provided in the embodiments disclosed in U.S. Provisional Application Ser. No. 61/448,585, the disclosure of which is expressly incorporated by reference herein.

Figure 16A:
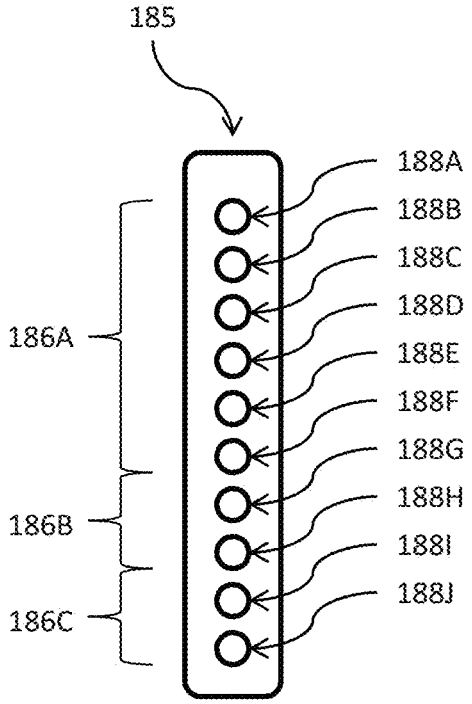
FIG. 16A is a partial view of the front view of FIG. 16.

Referring to FIG. 16A, a visual indicator 185 is shown. Visual indicator 185 includes a bank of LEDs 186A-J. The visual indicator 185 in one embodiment provides a visual indication of a plurality of functions. In one embodiment, visual indicator provides an indication of the remaining contact life of the circuit breaker being monitored and an indication of the gas density surrounding the circuit breaker. In one embodiment, visual indicator 185 toggles between displaying the remaining contact life and the gas density. In one example, each of the remaining contact life and the gas density is shown for approximately a ten second duration.

In one embodiment, a first portion 186A of the LEDs 188A-F are green in color. A second portion 186B of the LEDs 188G and 188H are yellow in color. A third portion 186C of the LEDs 188I and 188J are red in color.

In one embodiment, visual indicator 185 provides a visual indication of the remaining contact life as follows. All of LEDs 188 are illuminated to indicate full 100% contact life is available. As contact life is reduced the number of green LEDs illuminated decreases. The transition from the green LEDs to the yellow LEDs occurs at a danger setpoint for $I^NT$ duty. As such, when none of the green LEDs are illuminated, but the yellow and red are then the contact life has reached a danger zone. The transition from yellow LEDs to red LEDs occurs at 0% contact life remaining. As such, when only the red LEDs are illuminated the contact life is at 0%. When the upper red LED is also not illuminted then the contact life is 25% over its limit. When none of the LEDs are illuminated then the contact life is 50% over its limit. In one example, when in the yellow zone, all illuminated LEDs 188 flash slowly and when in the red zone, all illuminated LEDs flash quickly.

In one embodiment, visual indicator 185 provides a visual indication of the gas density as follows. The LEDs 188 provide a range of density values. Each LED 188 corresponds to a density level. When the determined density is at a given level, the respective LED 188 is illuminated. In one embodiment, the transition to the yellow LEDs occurs at a warning density and the transition to the red LEDs occurs at a danger density. The warning density and the danger density being programmable values.

Figure 17:
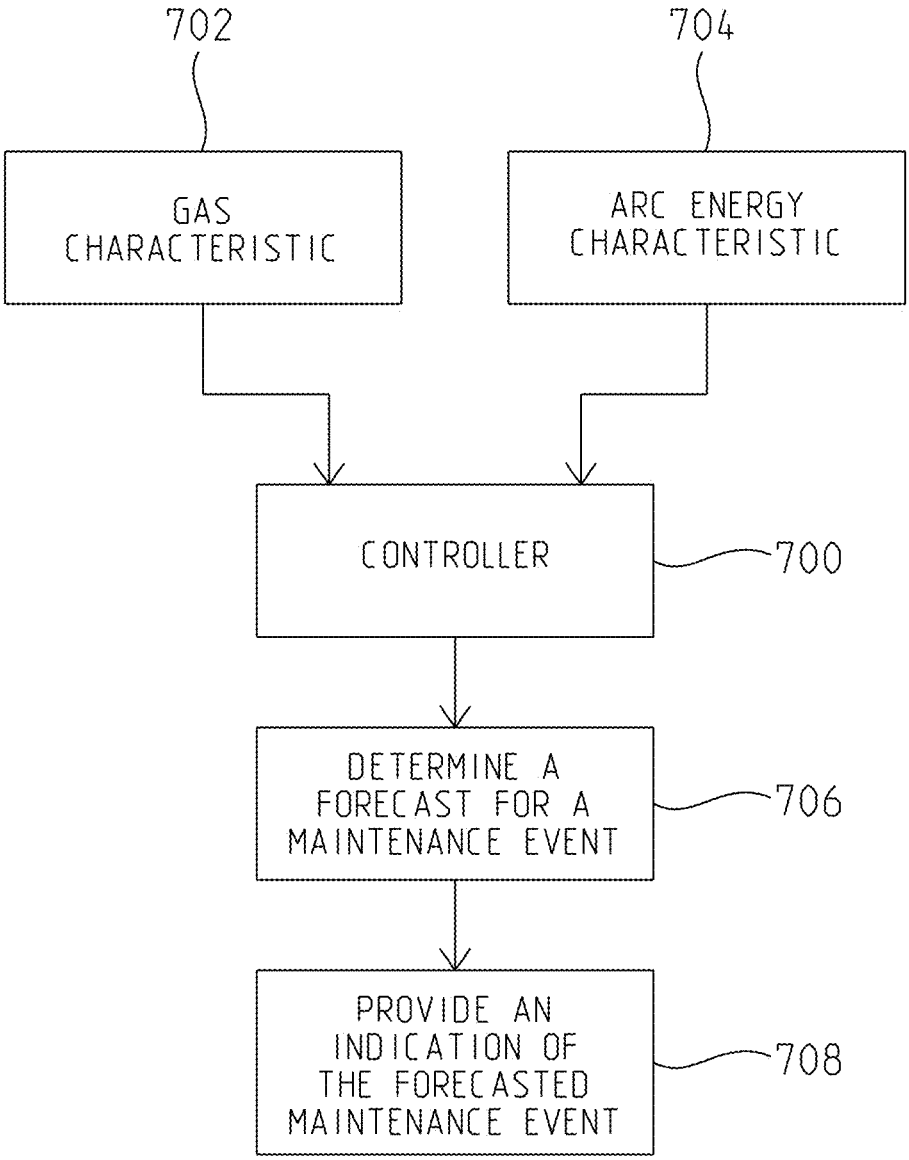
FIG. 17 is a representative view of an exemplary control scheme of the exemplary monitoring system of FIGS. 1A and 1B.

Referring to FIG. 17, a controller 700 receives an indication of at least one gas characteristic 702 and at least one fault arc energy characteristic 704. In one embodiment, the at least one gas characteristic is either a density value of the gas provided in the enclosure 122 (see FIG. 4) surrounding the circuit breaker 102 (see FIG. 4), a value from which the density value of the gas provided in the enclosure 122 (see FIG. 4) may be determined, a gas temperature value, or a combination thereof. An exemplary gas is $SF_6$. In one embodiment, the at least one fault arc energy characteristic is ($I^NT$ duty wherein N is in the range of about 1 to about 2), ($I^{1.4}T$), ($I^2T$), (IT), or other suitable arc characteristics.

Based on the at least one gas characteristic 702 and at least one fault arc energy characteristic 704, controller 700 determines a forecast for a maintenance event, as represented by block 706. In one embodiment, controller 700 determines a forecast for a maintenance event based on at least two gas characteristics, such as density and temperature. The controller 700 provides an indication of the forecasted maintenance event, as represented by block 762. Exemplary indications include visual indications, audio indications, tactile indications, communications to remote computing devices, and other suitable ways of providing a notification of a forecasted maintenance event. Exemplary visual indications include lights, gauges, information provided on a display, printed communication, faxed communication, and other indications perceivable by sight. Exemplary audio indications include audio tones or alarms produced by a speaker and other suitable indications perceivable by hearing. Exemplary tactile indications include a vibrating member and other suitable indications perceivable by touch. Communications to remote computing devices include any type of electronic data transfer over a serial connection, a wired network, a wireless network, or any other suitable connection between the controller and the remote computing device. Exemplary types of electronic data transfer include e-mail messages, instant messages, text messages, providing data for storage on a remote memory, and other suitable types of data transfer.

Figure 18:
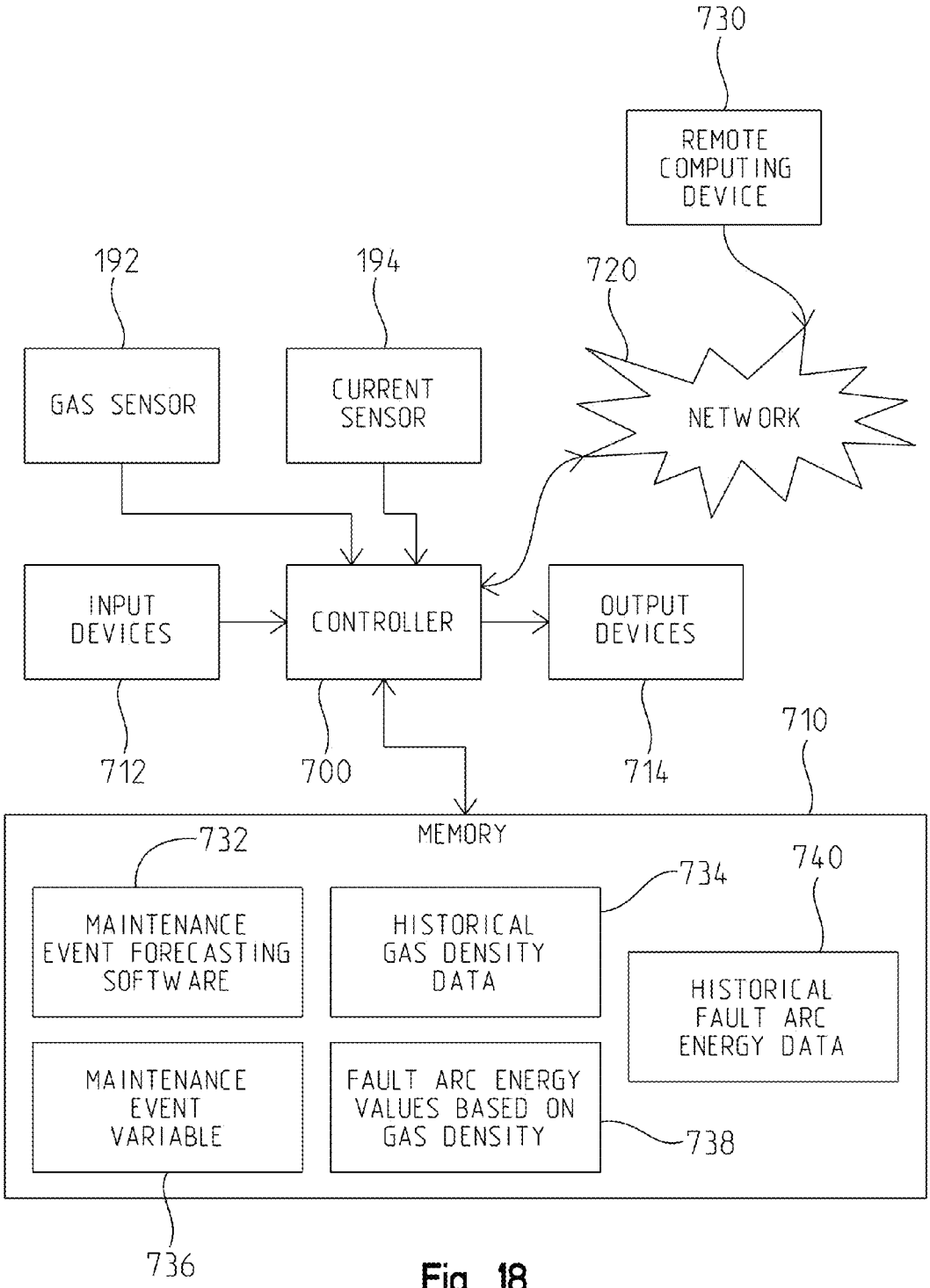
FIG. 18 is a representative view of an exemplary control system related to FIG. 17.

Referring to FIG. 18, controller 700, in the illustrated embodiment, is operatively connected to gas sensor 192 (see FIG. 4) and a current sensor 194 (see FIG. 4). In one embodiment, controller 700 performs all of the operations of controller 142 (see FIGS. 1A and 1B). Controller 700 may be further operatively coupled to one or more input devices 712 and one or more output devices 714. Exemplary input devices include a keyboard, a mouse, a trackball, a portable memory device, measurement devices, and other input devices. Exemplary measurement devices include vibration sensors, accelerometers, gas impurity sensors, weather sensors, lightning sensors, partial discharge sensors, IR sensors, Hall effect sensors, and DGA sensors. Exemplary output devices include a printer, a fax machine, a display, a portable memory device, and other exemplary output devices.

Controller 700 has access to a memory 710. In one embodiment, memory 710 includes the same information as memory 144. Memory 710 is a computer readable medium and may be a single storage device or may include multiple storage devices, located either locally with controller 700 or accessible across a network. Computer-readable media may be any available media that may be accessed by controller 700 and includes both volatile and non-volatile media. Further, computer readable-media may be one or both of removable and non-removable media. By way of example, computer-readable media may include, but is not limited to, RAM, ROM, EEPROM, flash memory or other memory technology, CD-ROM, Digital Versatile Disk (DVD) or other optical disk storage, magnetic cassettes, magnetic tape, magnetic disk storage or other magnetic storage devices, or any other medium which may be used to store the desired information and which may be accessed by controller 700.

Controller 700 executes maintenance event forecasting software 732 stored on the memory 710. Memory 710 further includes communications software, if controller 700 has access to a network 720, such as a local area network, a public switched network, a CAN network, any type of wired network, and any type of wireless network. An exemplary public switched network is the Internet. Exemplary communications software 112 includes e-mail software, internet browser software, and other types of software which permit controller 700 to communicate with other computing devices 730 across a network. Exemplary computing devices 730 include personal computers, smart phones, handheld computing devices, and other types of computing devices.

Memory 710 includes maintenance event forecasting software 732. Although described as software, it is understood that at least portions of the maintenance event forecasting software 732 may be implemented as hardware. As explained herein, maintenance event forecasting software 732 based on a plurality of inputs determines a future date for a maintenance event related to circuit breaker 102. Also, as explained herein maintenance event forecasting software 732 may reference one or more of historical gas density data 734, maintenance event variable 736, fault arc energy values based on gas density 738, and historical fault arc energy data 740.

Figures 20, 21:
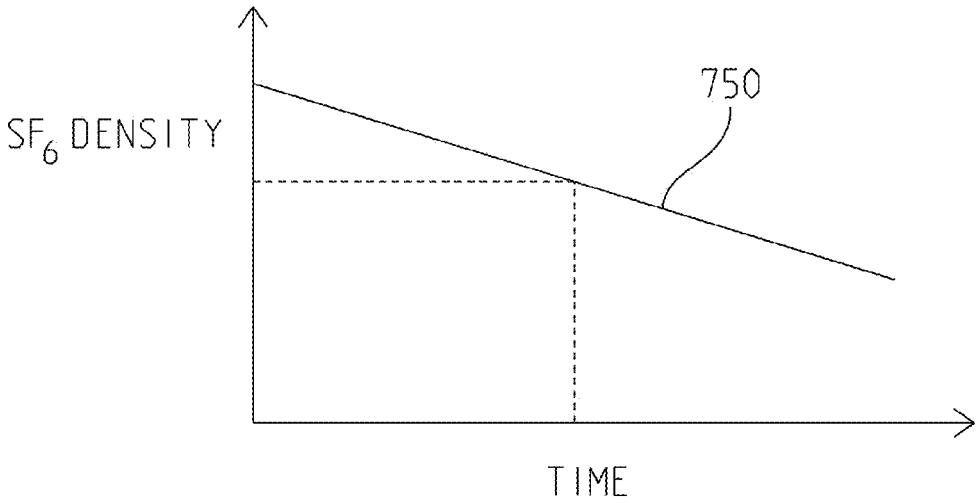
FIG. 20 is a representative view of the gas density in the enclosure of FIG. 3 over time.
FIG. 21 is a representative look-up table of gas densities and arc characteristics.

Historical fault arc energy data 740 is a measure of the amount of fault arc energy that circuit breaker 102 has experienced to date. Historical gas density data 734 provides gas density readings taken over time. Referring to FIG. 20, the gas density in enclosure 122 falls over time, as indicated by line 750. In FIG. 20, a linear relationship is shown. However, the gas density in enclosure 122 may change in a non-linear way. By determining an equation for line 750 it is possible to forecast gas density values for some time in the future. Maintenance event variable 736 provides an indication of the number of maintenance events that an operator wants to forecast. In one embodiment, the maintenance event variable value is set through a user interface.

The fault arc energy values based on gas density values 738 defines the relationship between gas density and fault arc energy. Referring to FIG. 21, a look-up table 752 is provided for a plurality of gas densities and the corresponding fault arc energy values. In one embodiment, the fault arc energy values are empirically determined. If a fault arc energy value for a gas density not specified in look-up table 752 is desired, maintenance event forecasting software 732 extrapolates the adjacent gas density values to determine an estimated fault arc energy value. In one embodiment, maintenance event forecasting software 732 performs a linear extrapolation.

Figure 19:
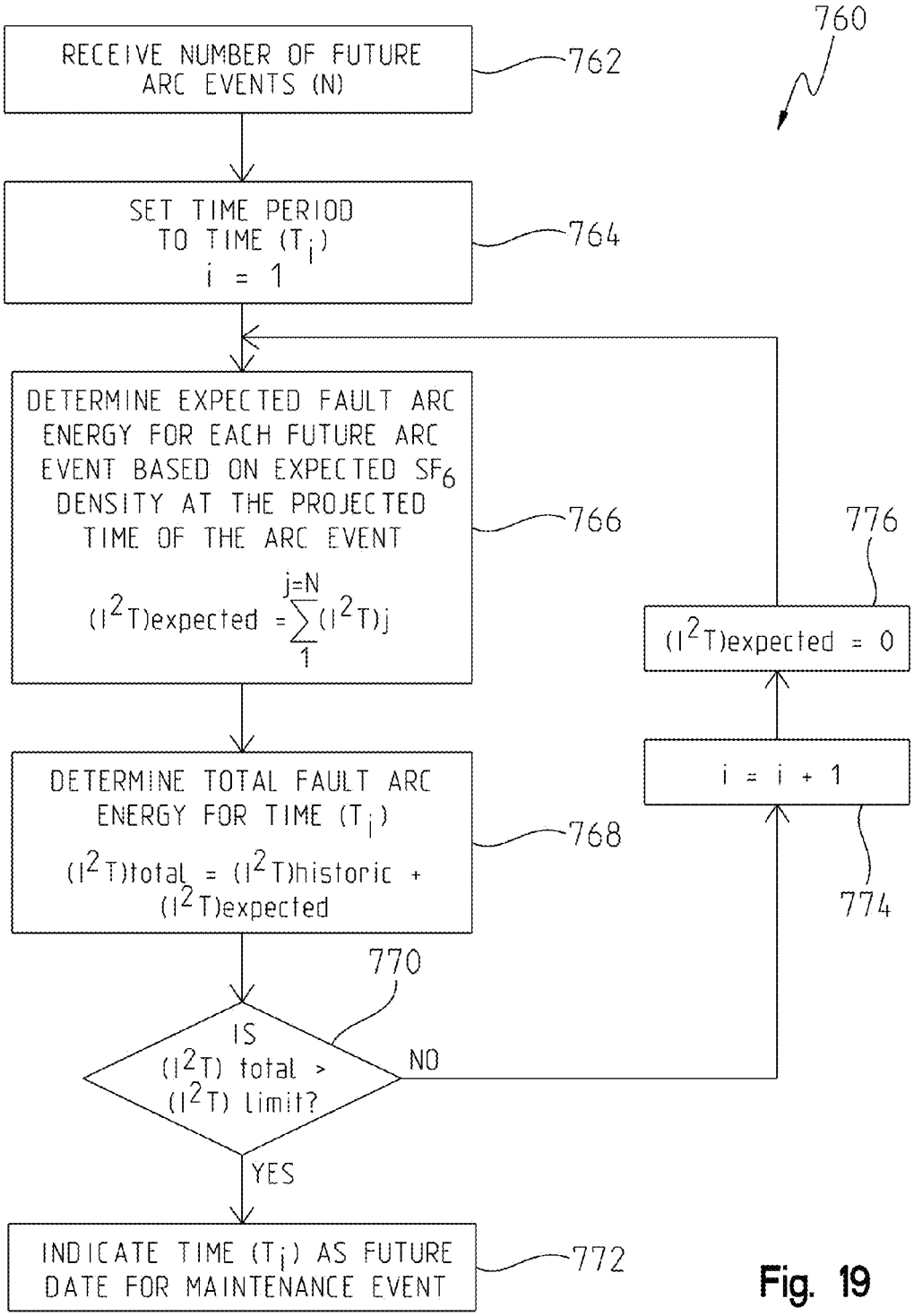
FIG. 19 is an exemplary processing sequence executed of the controller of FIG. 18.

Turning to FIG. 19, an exemplary processing sequence 760 of maintenance event forecasting software 732 is provided. The number of future fault arc energy events (N) to be forecasted is determined, as represented by block 762. In one embodiment, this number is the value of the stored maintenance event variable 736.

Maintenance event forecasting software 732 selects an initial time ($T_i$) in the future to evaluate for a potential maintenance event, as represented by block 764. As explained herein, if a forecasted maintenance event is not triggered at initial time ($T_i$), maintenance event forecasting software 732 increments the time period (i=i+1) to evaluate a time further in the future, as represented by block 774. In one embodiment, maintenance event forecasting software 732 increments by days. In one embodiment, maintenance event forecasting software 732 increments by weeks. Any suitable time block may be used for the incrementing. In one embodiment, maintenance event forecasting software 732 selects an initial time that is farther in the future and if a potential maintenance event is triggered at the initial time, decrements back towards the present day to determine the onset of the potential maintenance event.

At the time ($T_i$) maintenance event forecasting software 732 determines the expected fault arc energy for each future arc event based on the expected $SF_6$ gas density at the projected time for the arc event, as represented by block 766. As explained in the scenarios below, for multiple arc events, one or more may be at times other than $T_i$. The expected $SF_6$ gas density at a projected time is determined by maintenance event forecasting software 732 through an analysis of the historical gas density data. In one embodiment, maintenance event forecasting software 732 determines a linear regression of the historical gas density data and extrapolates that relationship out to the projected time. In the illustrated embodiment, the expected fault arc energy for each future arc event based on the expected $SF_6$ gas density at the projected time for arc event may be expressed as:

$$(I^2T)_{expected} = \sum_{1}^{j=N} (I^2T)_j \tag{1}$$

wherein N is the number of future arc events, $(I^2T)_j$ is the expected fault arc energy for the jth event, and $(I^2T)_{expected}$ is the total expected future fault arc energy for all of the future arc events. In one embodiment, $(I^2T)_j$ is determined from the look-up table of the fault arc energy values based on gas density 738. In one embodiment, wherein the circuit breaker 102 is a part of a three phase system, the look-up table 752 includes the highest potential I, phase to ground. In one embodiment, the value for $(I^2T)_j$ determined from look-up table 752 is scaled based on the travel time or arc time associated with the historical current data 740. For example, look-up table 752 may be based on an arc time of x, but it is observed by maintenance event forecasting software 732 that the prior arc time for circuit breaker 102 was 1.2×. In this situation, maintenance event forecasting software 732 may scale the value for $(I^2T)_j$ determined from look-up table 738. In one example, the scaling is a linear scaling.

Once the total expected future fault arc energy for all of the future arc events (N) is determined, maintenance event forecasting software 732 determines the total fault arc energy for time ($T_i$), as represented by block 768. In the illustrated embodiment, the total fault arc energy for time ($T_i$) may be expressed as:

$$(I^2T)_{total}(I^2T)_{historic}+(I^2T)_{expected} \tag{2}$$

wherein $(I^2T)_{total}$ is the total fault arc energy for the circuit breaker at time $T_i$, $(I^2T)_{historic}$ is the historical current data for the circuit breaker, and $(I^2T)_{expected}$ is the total expected future fault arc energy for all of the future arc events (N).

The $(I^2T)_{total}$ is compared to an $(I^2T)_{limit}$ which is specified as the trigger for the maintenance event, as represented by block 770. In one embodiment, $(I^2T_{limit}$ is the circuit breaker manufacturer specified danger limit and the maintenance event is exceeding this danger limit, being within a given percentage of this danger limit, or some other suitable criteria. In one example, the danger limit is 27,000,000 Amp squared seconds. In one embodiment, $(I^2T)_{limit}$ is the circuit breaker manufacturer specified warning limit and the maintenance event is exceeding this warning limit, being within a given percentage of this warning limit, or some other suitable criteria.

If $(I^2T)_{total}$ is greater than $(I^2T)_{limit}$, as represented by block 772, time $T_i$ is indicated as the future time corresponding to the maintenance event. Maintenance event forecasting software 732 may provide an indication of this time as mentioned herein in connection with block 708. If $(I^2T)_{total}$ is not greater than $(I^2T)_{limit}$, maintenance event forecasting software 732 increments the time, as represented by block 774, and resets $(I^2T)_{expected}$ to zero, as represented by block 776.

Maintenance event forecasting software 732 through processing sequence 760 may be used to forecast multiple types of scenarios of the timing of the future arc events.

In a first scenario, maintenance event forecasting software 732 may determine the time associated with a maintenance event that is caused by the next arc event. In this scenario, N is set equal to one and equation (1) may be expressed as equation 3:

$$(I^2T)_{expected}=(I^2T)_{at\ time\ T_i} \tag{3}$$

In a second scenario, maintenance event forecasting software 732 may determine the effect of a cluster of arcs (N) within a short period of time. Often times multiple arcs occur in a group, such as during a storm scenario. In one embodiment, maintenance event forecasting software 732 assumes that all of the arcs (N) happen at the same time $T_i$. In this scenario equation 1 may be expressed as equation 4:

$$(I^2T)_{expected}=N(I^2T)_{at\ time\ T_i} \tag{4}$$

This second scenario may be implemented to determine a likelihood of a maintenance event occurring during an approaching storm system. In one embodiment, historical data of the number of clustered arcs during storm activity, potentially as a function of wind speed, may be used to set a value for N.

In a third scenario, maintenance event forecasting software 732 may determine the effect of a plurality of arcs (N) occurring between the present time and time $T_i$ at equally spaced intervals. In this scenario equation 1 may be expressed as equation 5:

$$(I^2T)_{expected} = \sum_{1}^{j=N} (I^2T)_{j\ at\ time\ \frac{(j)(T_i)}{N}} \tag{5}$$

Unlike the second scenario, in this scenario the $(I^2T)$ for each future arc event should be determined independently from look-up table 752. In one embodiment, the arcs are scheduled to occur randomly or at an unequal interval. In one embodiment, the time period may correspond to a pre-determined schedule for the breaker to open and close. In one example, the time periods may be of even duration. In one example, the time periods may be of uneven duration.

In a fourth scenario, maintenance event forecasting software 732 may determine the number arcs (N) within a specified period of time that may occur prior to a maintenance event occurring. Exemplary time periods include a portion of a day, a day, a week, and other suitable time periods. For a given time period (D), the number of arcs (N) may be expressed as equation 6:

$$N_D = \frac{(I^2T)_{limit} - (I^2T)_{historic}}{(I^2T)_{expected}} \tag{6}$$

In one embodiment, maintenance event forecasting software 732 determines the number of arcs (N) for multiple time periods and provides an indication of each N to the user. For each time period the $(I^2T)_{expected}$ is based on the expected gas density. In one embodiment, maintenance event forecasting software 732 monitors multiple circuit breaker 102 and develops a maintenance schedule for the circuit breakers 102 based on the days that the N for each the respective circuit breakers falls below a given number.

In a fifth scenario, maintenance event forecasting software 732 may determine the number arcs (N) within a specified period of time that may occur prior to a maintenance event occurring. Exemplary time periods include a portion of a day, a day, a week, and other suitable time periods. For a given time period (D), the number of arcs (N) may be expressed as equation 7:

$$N_D = \frac{(I^2T)_{limit} - (I^2T)_{historic}}{(I^2T)_{expected}} \tag{7}$$

The $(I^2T)_{unexpected}$ is based on a desired gas density. In this manner, an operator may be provided an indication of the number of arc events that circuit breaker 102 may experience if the gas density within enclosure 122 is increased to the desired gas density. The gas density may be increased to the desired gas density by refilling the gas level within enclosure 122.

In one embodiment, the controller 700 based on at least the at least gas characteristic determines the whether a future opening of circuit breaker 102 would provide a risk of failure of the circuit breaker 102, potentially resulting in damage to additional components in the proximity of circuit breaker 102. In one example, the risk of failure corresponds to the $(I^2T)_{total}$ being above a threshold amount. If the opening of circuit breaker 102 would provide a risk of failure then controller 700 will not open circuit breaker 102, will provide a notification to a controller controlling circuit breaker 102 to not open circuit breaker 102, and/or will provide a notification to a remote controller to open another circuit breaker operatively coupled to circuit breaker 102 instead of circuit breaker 102. In one example, a statistically average fault arc energy is used by controller 700 for the determination. In one embodiment, controller 700 executes one of the above-mentioned scenarios to determine one of a number of arc events that may occur prior to circuit breaker 102 providing a risk of failure or a time which would relate to circuit breaker 102 providing a risk of failure.

In one embodiment, controller 700 operates a switch operatively coupled to the trip circuit of circuit breaker 102 to prevent the opening of circuit breaker 102. In one example, the switch is in series with a Solon switch which is also operatively coupled to the trip circuit.

Although $(I^2T)$ is discussed as the fault arc energy measure, IT may be used or another fault arc energy measure.

In one embodiment, monitoring system 100 monitors when a current passing through circuit breaker 102 exceeds a threshold amount and the length of time that the current is above this threshold. In one example, only the current passing through the breaker while the breaker is in a closed state is monitored relative to the threshold. This may be used as a measure of condition for other components used with monitoring system 100, such as transformers.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A method of monitoring a circuit breaker provided in a gas filled enclosure, comprising:

determining at least one gas characteristic of a gas in the enclosure;

determining at least one fault arc energy characteristic of the circuit breaker; and forecasting with an electronic controller a maintenance event for the circuit breaker based on both the determined at least one gas characteristic and the determined at least one fault arc energy characteristic.

2. The method of claim 1, wherein the at least one gas characteristic includes a gas density.

3. The method of claim 2, wherein the at least one fault arc energy characteristic includes an $I^N T$ duty wherein I is a current passing through the circuit breaker, T is a time period, and N is in the range of about 1 to about 2.

4. The method of claim 1, further comprising the step of providing an indication of the forecasted maintenance event to a remote computing device.

5. The method of claim 1, wherein the step of forecasting the maintenance event includes determining an expected value of the at least one fault arc energy characteristic at a corresponding expected value of the at least one gas characteristic, the corresponding expected value of the at least one gas characteristic being less than the determined at least one gas characteristic.

6. The method of claim 1, wherein the step of forecasting the maintenance event includes the steps of determining an expected value of the at least one fault arc characteristic at a future time value, the expected value of the at least one fault arc characteristic being determined based on an expected value of the at least one gas characteristic at the future time value;

determining if the expected value of the at least one fault arc characteristic causes a limit value for the at least one fault arc characteristic to be reached; and if the limit value is caused to be reached based on the expected value of the at least one fault arc characteristic then forecasting the maintenance event to occur at the future time value.

7. The method of claim 1, wherein the step of forecasting the maintenance event includes the steps of selecting a future time ($T_i$) to evaluate for a potential maintenance event;

determining an expected fault arc energy $$\left(\sum_{1}^{j=N} (I^2T)_j\right)$$

at the future time ($T_i$) based on an expected value of the at least one gas characteristic, wherein N is a number of future arc events and $(I^2T)_j$ is an expected fault arc energy for the jth arc event;

determining a cumulative fault arc energy based on a historical fault arc energy and the expected fault arc energy; and comparing the cumulative fault arc energy with a limit to determine if the future time ($T_i$) corresponds to the maintenance event.

8. The method of claim 1, wherein the step of forecasting the maintenance event includes the steps of determining a future time whereat the at least one fault arc characteristic of a first arc event corresponds to the maintenance event.

9. The method of claim 8, wherein the at least one gas characteristic at the future time being determined based on a trend of the at least one gas characteristic and the at least one fault arc characteristic of the first arc event is based on the at least one gas characteristic at the future time.

10. The method of claim 1, wherein the step of forecasting the maintenance event includes the steps of determining a future time whereat the at least one fault arc characteristic of a plurality of arc events correspond to a maintenance event.

11. The method of claim 8, wherein the at least one gas characteristic at the future time being determined based on a trend of the at least one gas characteristic and the at least one fault arc characteristic of the plurality of arc events is based on the at least one gas characteristic at the future time.

12. The method of claim 11, wherein the plurality of arc events are clustered at the future time.

13. The method of claim 11, wherein the plurality of arc events are spaced apart between a current time and the future time.

14. The method of claim 1, wherein the step of forecasting the maintenance event includes the steps of determining a number of future arc events within a time period prior to the maintenance event.

15. The method of claim 14, wherein the number of future arc events being based on a decreasing trend of the at least one gas characteristic.

16. The method of claim 14, wherein the number of future arc events being based on the at least one gas characteristic being set to a first value.

17. A monitoring system for a circuit breaker being monitored by at least one current sensor operatively coupled to the circuit breaker and being provided in an interior of a gas filled enclosure being monitored by at least one gas sensor in fluid communication with the interior of the gas filled enclosure, the system comprising:

a monitoring unit operatively coupled to the at least one current sensor and the at least one gas sensor, the monitoring unit including an electronic controller configured to forecast a maintenance event for the circuit breaker based on both a determined at least one gas characteristic and a determined at least one fault arc energy characteristic.

18. The monitoring system of claim 17, further comprising a visual indicator which provides a visual indication of a plurality of conditions associated with the circuit breaker.

19. The monitoring system of claim 18, wherein the visual indicator toggles between an indication of a remaining contact life of the circuit breaker and an indication of a gas density surrounding the circuit breaker.

20. A monitoring system for a circuit breaker being monitored by at least one current sensor operatively coupled to the circuit breaker and being provided in an interior of a gas filled enclosure being monitored by at least one gas sensor in fluid communication with the interior of the gas filled enclosure, the system comprising:

a monitoring unit operatively coupled to the at least one current sensor and the at least one gas sensor, the monitoring unit including an electronic controller configured to forecast a maintenance event for the circuit breaker based on readings from the at least one current sensor and the at least one gas sensor; and a visual indicator which provides a visual indication of a plurality of conditions associated with the circuit breaker, wherein the visual indicator toggles between an indication of a remaining contact life of the circuit breaker and an indication of a gas density surrounding the circuit breaker.

21. A method of controlling a circuit breaker provided in a gas filled enclosure, comprising:

determining at least one gas characteristic of a gas in the enclosure;

determining at least one fault arc energy characteristic of the circuit breaker; and preventing an operation of the circuit breaker if a subsequent arc event corresponds to a potential future failure of the circuit breaker, the subsequent arc event being determined based on both the determined at least one gas characteristic and the determined at least one fault arc energy characteristic.

22. The method of claim 21, wherein the at least one gas characteristic includes a gas density.

23. The method of claim 22, wherein the at least one fault energy characteristic includes an $I^N T$ duty wherein I is a current passing through the circuit breaker, T is a time period, and N is in the range of about 1 to about 2.

24. A monitoring system for a circuit breaker being monitored by at least one current sensor operatively coupled to the circuit breaker and being provided in an interior of a gas filled enclosure being monitored by at least one gas sensor in fluid communication with the interior of the gas filled enclosure, the system comprising:

a monitoring unit operatively coupled to the at least one current sensor and the at least one gas sensor, the monitoring unit including an electronic controller configured to prevent an operation of the circuit breaker if a subsequent arc event corresponds to a potential future failure of the circuit breaker, the subsequent arc event being determined based on both a determined at least one gas characteristic and a determined at least one fault arc energy characteristic.

25. A monitoring system for a circuit breaker being monitored by at least one current sensor operatively coupled to the circuit breaker and being provided in an interior of a gas filled enclosure being monitored by at least one gas sensor in fluid communication with the interior of the gas filled enclosure, the system comprising:

a monitoring unit operatively coupled to the at least one current sensor and the at least one gas sensor, the monitoring unit including an electronic controller configured to at least one of forecast a maintenance event for the circuit breaker and prevent an operation of the circuit breaker if a subsequent arc event corresponds to a potential future failure of the circuit breaker; and a port to receive a portable memory device, the portable memory device including at least one script to at least one of upload information to a memory associated with the electronic controller and download information from the memory associated with the electronic controller.

26. The monitoring system of claim 25, wherein the portable memory device includes the at least one script to be executed when the portable memory device is coupled to the port.

27. The monitoring system of claim 26, wherein a first script is an Alarm Reset script configured to cause the electronic controller of the monitoring unit to reset at least one active alarms.

28. The monitoring system of claim 25, wherein the portable memory device includes a script selection input which is actuatable from an exterior of the portable memory device, the script selection input having a plurality of settings each corresponding to a unique script.

29. The monitoring system of claim 25, wherein the electronic controller forecasts the maintenance event based on both a determined at least one gas characteristic and a determined at least one fault arc energy characteristic.

30. The monitoring system of claim 25, wherein the subsequent arc event is determined based on both a determined at least one gas characteristic and a determined at least one fault arc energy characteristic.

31. A monitoring system for a circuit breaker being monitored by at least one sensor, the system comprising:

a monitoring unit operatively coupled to the at least one sensor, the monitoring unit including an electronic controller based on input from the at least one sensor being configured to at least one of forecast a maintenance event for the circuit breaker and prevent an operation of the circuit breaker if a subsequent arc event corresponds to a potential future failure of the circuit breaker; and at least one sensor connection adapted to couple to the at least one sensor, wherein when the at least one sensor is coupled to the at least one sensor connection the electronic controller configures the at least one sensor as one of an analog sensor and a digital sensor and verifies the presence of the at least one sensor.

32. The monitoring system of claim 31, wherein if the at least one sensor is not providing a signal the electronic controller initiates an alarm.

33. The monitoring system of claim 31, wherein the electronic controller records a plurality of readings from the at least one sensor and if a present readings differs from at least one prior reading by more than a threshold amount the electronic controller initiates an alarm.

34. A monitoring system for a circuit breaker provided in an interior of a gas filled enclosure being monitored by at least one gas sensor in fluid communication with the interior of the gas filled enclosure, the system comprising:

a monitoring unit operatively coupled to the at least one sensor, the monitoring unit including an electronic controller based on input from the at least one gas sensor being configured to at least one of forecast a maintenance event for the circuit breaker and prevent an operation of the circuit breaker if a subsequent arc event corresponds to a potential future failure of the circuit breaker, wherein the electronic controller records measurement readings received from the at least one gas sensor over a first calculation period, determines a trend line for the measurement readings, a confidence level for the trend line, and based on a characteristic of the trend line and the confidence level determines if an alarm condition is present.

35. A monitoring system for a circuit breaker provided in an interior of a gas filled enclosure being monitored by at least one gas sensor in fluid communication with the interior of the gas filled enclosure, the system comprising:

a monitoring unit operatively coupled to the at least one sensor, the monitoring unit including an electronic controller based on input from the at least one gas sensor being configured to at least one of forecast a maintenance event for the circuit breaker and prevent an operation of the circuit breaker if a subsequent arc event corresponds to a potential future failure of the circuit breaker, wherein the electronic controller records measurement readings received from the at least one gas sensor over a first calculation period and over a second calculation period, the second calculation period including the first calculation period;

determines a first trend line for the measurement readings of the first calculation period;

determines a second trend line for the measurement readings of the second calculation period;

selects one of the first trend line and the second trend line; and forecasts the maintenance event based on a characteristic of the selected trend line.

36. A monitoring system for a circuit breaker provided in an interior of a gas filled enclosure being monitored by at least one gas sensor in fluid communication with the interior of the gas filled enclosure, the system comprising:

a monitoring unit operatively coupled to the at least one sensor, the monitoring unit including an electronic controller based on input from the at least one gas sensor being configured to at least one of forecast a maintenance event for the circuit breaker and prevent an operation of the circuit breaker if a subsequent arc event corresponds to a potential future failure of the circuit breaker, wherein the electronic controller determines a fill event wherein additional gas is provided to the interior of the enclosure based on measurement readings from the at least one gas sensor.

37. The monitoring system of claim 36, wherein the electronic controller records measurement readings received from the at least one gas sensor over a first calculation period and over a second calculation period, the second calculation period including a more current measurement reading than the first calculation period;

determines a first mean density value for the first calculation period; and determines a second mean density value for the second calculation period, wherein the fill event is determined based on the second mean density value exceeding the first mean density value.

38. A monitoring system for a circuit breaker provided in an interior of a gas filled enclosure being monitored by at least one gas sensor in fluid communication with the interior of the gas filled enclosure, the system comprising:

a monitoring unit operatively coupled to the at least one sensor, the monitoring unit including an electronic controller based on input from the at least one gas sensor being configured to at least one of forecast a maintenance event for the circuit breaker and prevent an operation of the circuit breaker if a subsequent arc event corresponds to a potential future failure of the circuit breaker;

a fill valve being in fluid communication with the interior of the gas filled enclosure; and a volumetric flowmeter operatively coupled to the electronic controller and located to monitor an amount of gas being passed through the fill valve to the interior of the gas filled enclosure.

39. The monitoring system of claim 38, wherein the volumetric flowmeter is supported by a pressurized gas supply coupled to the fill valve.

40. The monitoring system of claim 38, wherein the volumetric flowmeter is supported by the enclosure.

* * * * *